US010352168B2

(12) United States Patent
McKelvey

(10) Patent No.: US 10,352,168 B2
(45) **Date of Patent: *Jul. 16, 2019**

(54) OFFSET ROTATIONAL INTERNAL COMBUSTION ENGINE WITH CENTRIFUGAL GASOLINE PRESSURE

(71) Applicant: William W. McKelvey, Van Nuys, CA (US)

(72) Inventor: William W. McKelvey, Van Nuys, CA (US)

( * ) Notice: Subject to any disclaimer, the term of this patent is extended or adjusted under 35 U.S.C. 154(b) by 3 days.

This patent is subject to a terminal disclaimer.

(21) Appl. No.: 15/729,481

(22) Filed: Oct. 10, 2017

(65) Prior Publication Data

US 2018/0045047 A1 Feb. 15, 2018

Related U.S. Application Data

(63) Continuation of application No. 14/212,586, filed on Mar. 14, 2014, now Pat. No. 9,784,105.

(51) Int. Cl.

| | |
|---|---|
| ***F01B 13/06*** | (2006.01) |
| ***F02B 57/08*** | (2006.01) |
| ***F02B 57/10*** | (2006.01) |
| *F01B 1/06* | (2006.01) |

(52) U.S. Cl.

CPC ..... *F01B 13/062* (2013.01); *F01B 13/067* (2013.01); *F02B 57/08* (2013.01); *F02B 57/10* (2013.01); *F01B 1/0603* (2013.01); *F02B 57/085* (2013.01); *Y10T 29/49234* (2015.01)

(58) Field of Classification Search

CPC ..... F02B 57/08; F02B 57/10; F02B 57/085; F02B 13/062; F02B 13/067; F02B 1/0603; Y10T 29/49234

USPC ..... 123/44 R, 44 A, 44 B, 44 C

See application file for complete search history.

(56) References Cited

U.S. PATENT DOCUMENTS

| | | | |
|---|---|---|---|
| 580,838 | A | 4/1897 | Almond |
| 1,576,392 | A | 3/1926 | Williams |
| 5,103,775 | A | 4/1992 | Hue |
| 6,526,925 | B1 | 3/2003 | Green, Jr. |
| 7,520,251 | B2 | 4/2009 | Saari |
| 7,721,687 | B1 | 5/2010 | Lockshaw et al. |
| 7,827,956 | B2 | 11/2010 | Ambardekar et al. |

(Continued)

FOREIGN PATENT DOCUMENTS

| | | |
|---|---|---|
| CN | 1127324 | 7/1996 |

*Primary Examiner* — Hoang M Nguyen

(74) *Attorney, Agent, or Firm* — William W. Cochran; Cochran Freund & Young LLC

(57) ABSTRACT

Disclosed is an offset rotational internal combustion engine in which an outer ring rotates on a one axis and an inner disk rotates on a second offset axis. Pistons are connected to the outer ring, while cylinders and other devices for operating the engine are mounted within an inner disk that rotates on a second axis that is offset from the axis of the outer ring. The inner disk and outer ring rotate together, such that the pistons create conditions of compression and explosive expansion within the cylinders without vibrating reciprocal piston motion. A unique fuel injection system is also disclosed that provides a variable fuel pressure that is created by centrifugal forces on the fuel. Because of the rotating inner disk and outer ring, advantages are taken of centrifugal force and gravity to distribute fuel, air, oil, high-voltage current, and cooling air in the engine.

12 Claims, 26 Drawing Sheets

(56) References Cited

U.S. PATENT DOCUMENTS

| | | | | |
|---|---|---|---|---|
| 9,784,105 | B2 * | 10/2017 | McKelvey | F01B 13/062 |
| 2006/0231048 | A1 | 10/2006 | Li | |

* cited by examiner

OFFSET ROTATIONAL INTERNAL COMBUSTION ENGINE WITH CENTRIFUGAL GASOLINE PRESSURE

CROSS-REFERENCE TO RELATED APPLICATION

The present application is based upon and claims the benefit of U.S. Provisional Patent Application No. 61/798,700 entitled "OFFSET ROTATIONAL NON-RECIPROCATING-PISTON INTERNAL COMBUSTION ENGINE", and filed Mar. 15, 2013. This application is a continuation of U.S. Non-Provisional patent application Ser. No. 14/212,586 filed Mar. 14, 2014 by William W. McKelvey entitled "OFFSET ROTATIONAL INTERNAL COMBUSTION ENGINE." The entire contents of the above-mentioned applications are hereby specifically incorporated herein by reference for all that they disclose and teach.

BACKGROUND

The Otto and Diesel internal-combustion engines have existed for over 100 years. These types of internal-combustion engines have many advantages and some disadvantages, including considerable vibration, many moving parts, a large number of parts that are subject to failure, and difficulties in making repairs, since many of these parts are embedded inside these complex engines.

In Wankel-type rotary engines, reciprocating pistons are replaced by rotors that orbit eccentrically around a center axis. The rotor in the Wankel-type engine is triangularly shaped and rotates within a surrounding chamber. The Wankel-type engine is simple and has a small number of moving parts. The disadvantages are that very high friction is created, which results in high wear, inefficiency, frequent failure, and limited rotational speed and power.

SUMMARY

An embodiment of the invention may therefore comprise an offset rotational internal combustion engine comprising: an outer ring that rotates substantially symmetrically around an outer-ring rotational axis; pistons that are attached to the outer ring; an inner disk located inside of the outer ring that rotates around an inner disk rotational axis, the inner disk rotational axis being offset from the outer-ring rotational axis; cylinders mounted on the inner disk that engage the pistons; gears connected to the inner disk and the outer ring that cause the inner disk and the outer ring to rotate together so that the cylinders on the inner disk are substantially aligned with the pistons attached to the outer ring when the outer ring rotates around the outer ring rotational axis and the inner disk rotates around the inner ring rotational axis; a fuel pipe extending from an inner disk support column toward an outer edge of the inner disk to a fuel pipe that encircles the outer portion of the inner disk that uses centrifugal force from increased rotational speed to increase fuel pressure from the fuel pipe to injectors which supplies additional fuel and power to the engine; a primary oil tube located in an inner disk support column; additional oil tubes located in the inner disk that transfer oil from the primary oil tube to components of the engine located on the inner disk by using both an external oil pump and centrifugal forces on the oil created by rotation of the inner disk; caps that are bolted to top and bottom portions of an end of an upper center support column and an end of a lower center support column that cover the engine and allow the engine to be quickly and easily accessed so that internal portions of the engine can be disassembled, maintained, and re-assembled with standard hand tools, An embodiment of the invention may further comprise a method of making an offset rotational internal combustion engine comprising: an outer ring that rotates substantially symmetrically around an outer ring rotational axis; attaching pistons to the outer ring; providing an inner disk positioned inside of the outer ring that rotates around an inner disk rotational axis that is offset from the outer ring rotational axis; mounting cylinders on the inner disk that engage the pistons; providing gears that cause the outer ring and the inner disk to rotate together so that the cylinders on the inner disk are substantially aligned with the pistons attached to the outer ring when the outer ring rotates around the outer ring rotational axis and the inner disk rotates around the inner disk rotational axis; mounting a fuel ring near an outer edge of the inner disk to create higher fuel pressures caused by centrifugal force on fuel as a result of centrifugal forces on the fuel that are caused by increased rotation speed of the inner disk; distributing oil to the engine through an oil tube inside a stationary inner disk support column that is connected to oil tubes disposed in a direction toward an outer edge of the inner disk, so that oil flows through the engine as a result of centrifugal force on the oil from rotation of the inner disk; assembling the engine using caps that are secured at a top end portion of the inner ring support column and a bottom end portion of an outer-ring support column, such that the engine can be assembled and disassembled with standard hand tools.

DETAILED DESCRIPTION OF THE EMBODIMENTS

Figure 1:
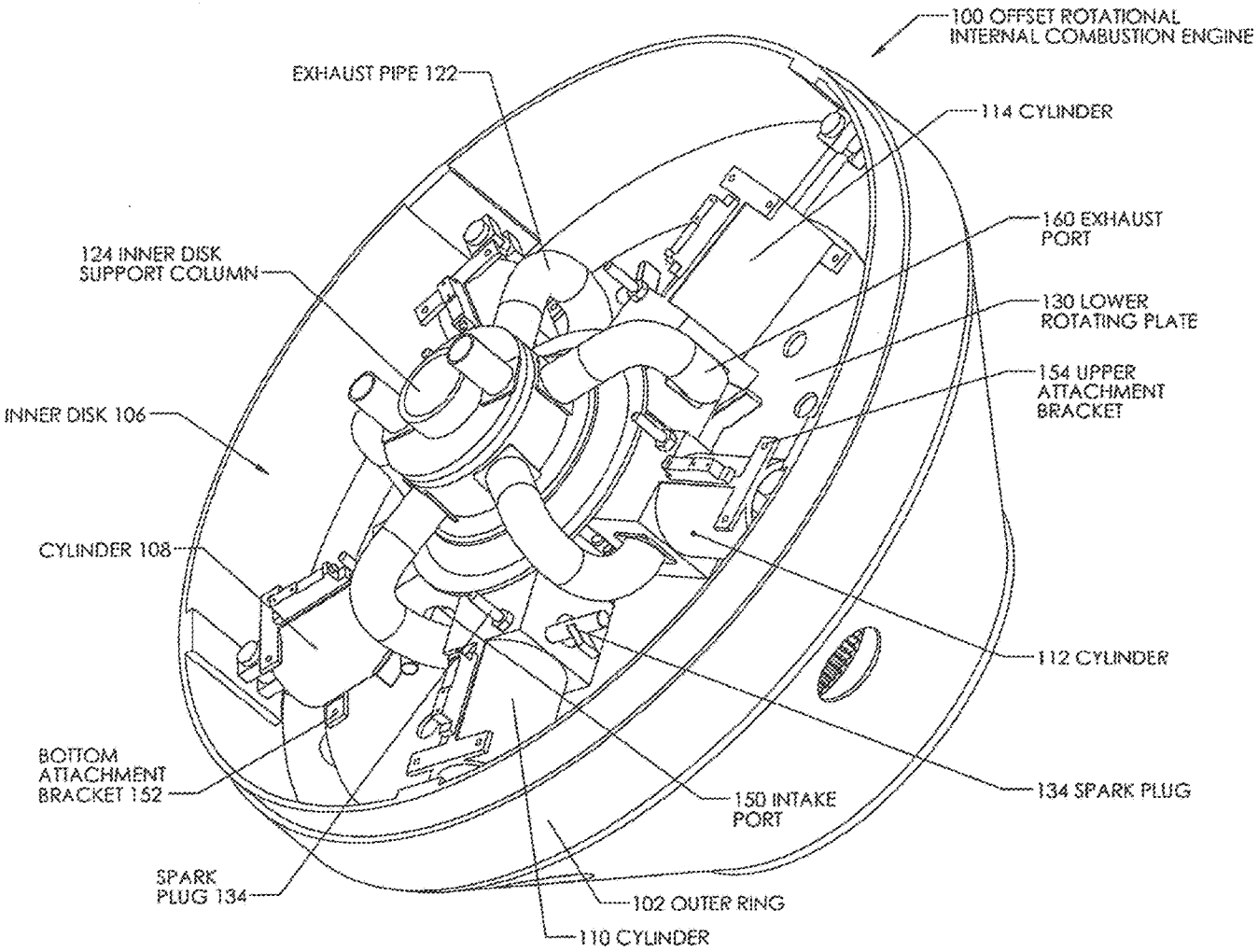
FIG. 1 is a schematic isometric illustration of an example embodiment of an offset rotational non-reciprocating-piston internal combustion engine.

FIG. 1 is a top-down perspective view of an example embodiment of an offset rotational internal combustion engine 100. The engine includes an outer ring 102, which rotates within the lower engine housing 498 (see FIG. 23). The outer ring 102 and lower engine housing 498 surround an inner disk 106. A plurality of cylinders, for example, the five cylinders 108, 110, 112, 114, 115, are mounted on, and connected to, the lower plate 130 of the inner disk 106. Any convenient number of cylinders can be provided, but this description will proceed with the example of five cylinders and with the associated components for five cylinders. A plurality of corresponding exhaust pipes 116, 118, 120, 122, 123 are connected in fluid-flow relation to the cylinders 108-114, respectively. Spark plugs 132, 134, 136, 138, 139 are mounted in the cylinders 108-114, respectively, to ignite a compressed fuel/air mixture in the cylinders 108-115. A piston fits slideably within each of the cylinders 108-115; each piston is connected to the outer ring 102 by way of a piston rod, i.e., rods 140, 142, 144, 146, 148 (not all of which can be seen in FIG. 1). The piston rods are connected to the outer ring 102 by way of piston rod connectors, such as the respective piston rod connectors 141, 143, 145, 147, 149 (not all of which can be seen in FIG. 1). As explained in more detail below, both the inner disk 106, and the outer ring 102, rotate together with the inner disk 106 offset from the outer ring 102, which causes relative movement between the inner disk 106 and the outer ring 102, such that there is relative back and forth movement between the non-reciprocating pistons and the cylinders, during each complete revolution of the outer ring 102 and inner disk 106.

Figure 2:
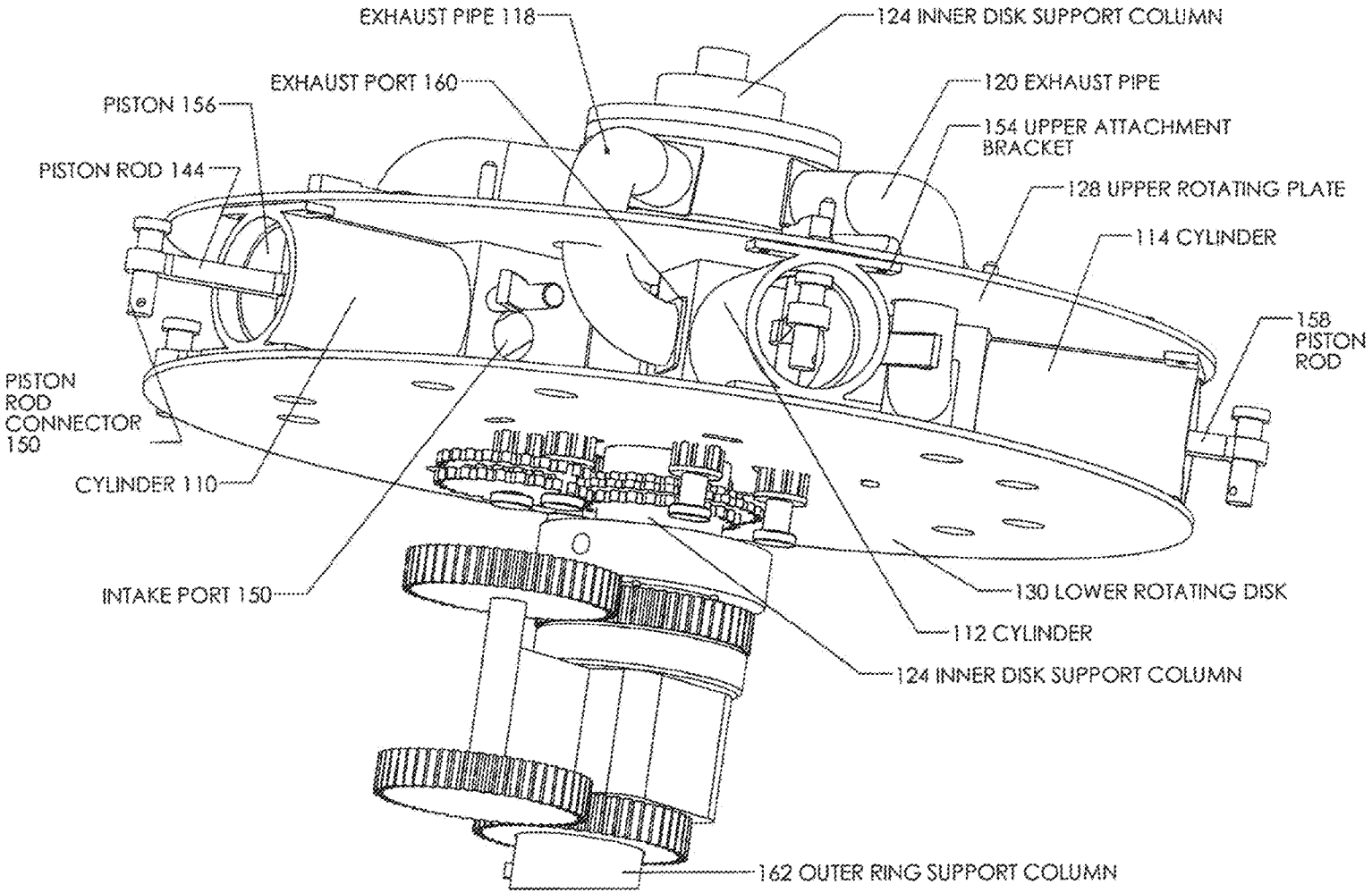
FIG. 2 is a schematic isometric diagram of a portion of the embodiment of FIG. 1.

As also illustrated in FIG. 1, the cylinders are positioned on the lower rotating plate 130 by way of attachment brackets, such as the lower or bottom attachment bracket 152. Each cylinder also has upper attachment brackets, such as the upper attachment bracket 154 in FIG. 1, that attaches the cylinder to the upper plate 128 (FIG. 2). The inner disk 106 rotates around the inner disk support column 124, which is offset from the centerline of the outer ring 102.

FIG. 2 is an isometric view of portions of the embodiment of the offset rotational non-reciprocating-piston internal combustion engine illustrated in FIG. 1. As illustrated in FIG. 2, the inner disk 106 comprises an upper rotating plate 128 and a lower rotating plate 130. As indicated above, a large number of devices are mounted on the inner disk 106. For example, cylinders 108, 110, 112, 114, 115 (not all of which can be seen in FIG. 2) are mounted within the inner disk 106 between the upper plate 128 and lower plate 130. As illustrated in FIG. 2, the upper attachment bracket 154 of cylinder 112 is attached to the upper plate 128 of the inner disk 106. The other cylinders 108, 110, 114, 115 have similar upper attachment brackets. Cylinders 108, 110, 112, 114, 115 also have lower attachment brackets 152 that are connected to the lower plate 130.

As also illustrated in FIG. 2, cylinder 110 mates with piston 156. The piston 156 is attached to a piston rod 142. The piston rod has a round opening, which is coupled to a piston rod connector 143 that couples the piston rod 142 to the outer ring 102 (FIG. 1.). Piston 156, which is located in cylinder 110, has a piston rod connector 143 to connect the piston 156 to the outer ring 102 (FIG. 1). Piston rod 146, which is located in cylinder 114, has piston rod connector 147 to connect piston rod 146 to outer ring 102 (FIG. 1). The pistons, piston rods, and piston rod connectors that are not visible in FIG. 2 are assembled and connected in the same manner.

FIG. 2 also shows that exhaust pipe 118 is connected to exhaust port 160. Exhaust pipe 120 is connected to a similar exhaust port that is for cylinder 114. Upper attachment bracket 154 attaches cylinder 112 to the upper rotating plate 128. Inner disk support column 124 comprises the centerline and rotational axis 174 for the inner disk 106. Intake port 150 is coupled to cylinder 110, Inner disk support column 124, illustrated at the top of FIG. 2, extends through the inner disk 106 and through the lower rotating plate 130, as illustrated in FIG. 2. Details pertaining to how all the gears shown in FIG. 2 interconnect are illustrated, for example, in FIG. 6.

Figure 3:
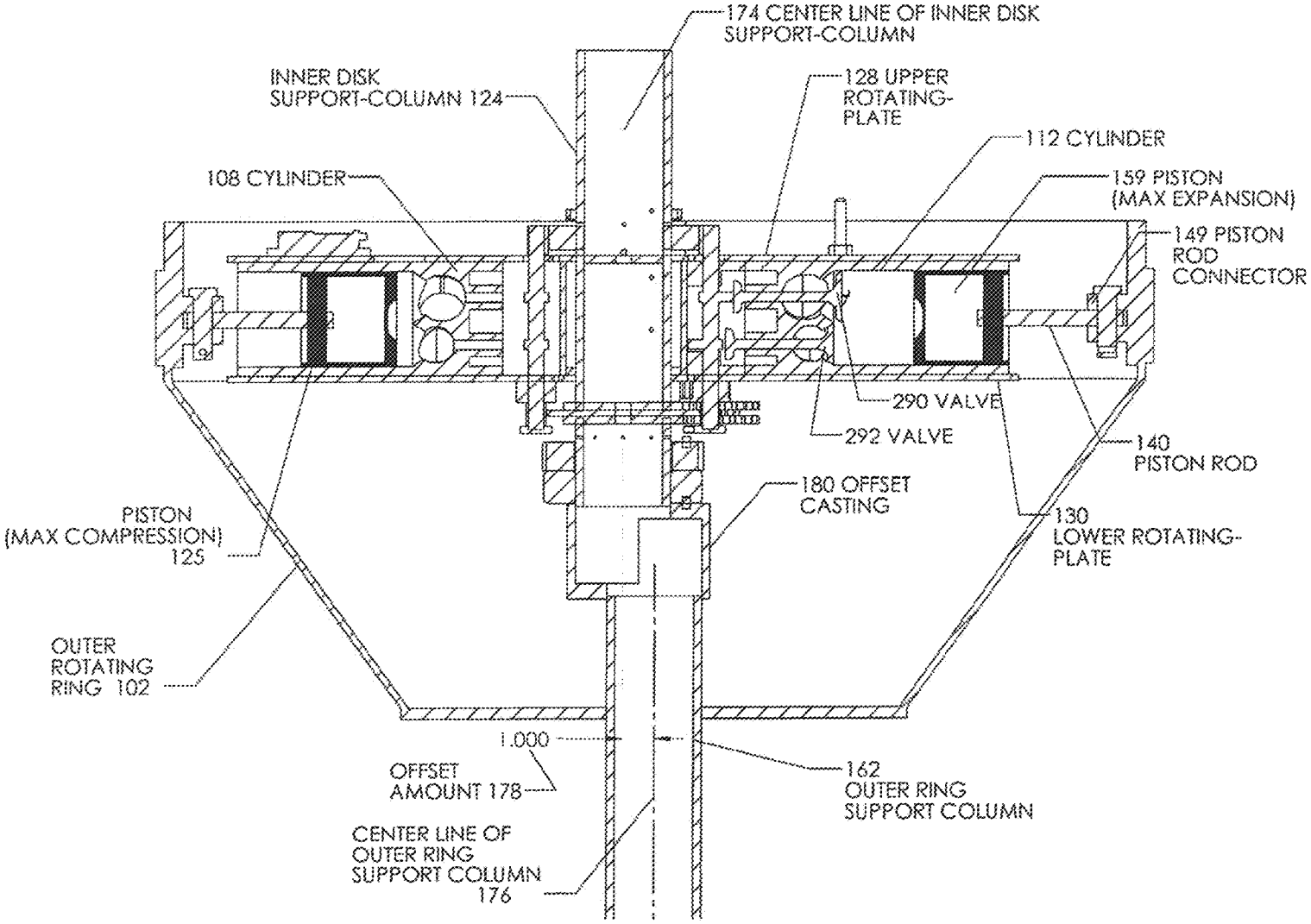
FIG. 3 is a cutaway view of the embodiment of FIG. 1.

FIG. 3 is a sectional view of the example embodiment of an offset rotational internal combustion engine 100, illustrated in FIG. 1. As shown in FIG. 3, the inner disk support column 124 has a centerline 174 that is offset from the centerline 176 of the outer ring center support column 162. The offset casting 180 provides an offset between the inner disk support column 124 and the outer ring center support column 162. The offset amount 178 is one-half of the relative movement of the pistons within the cylinders. For example, piston 159 is located in cylinder 112. Piston 159 is coupled to the outer ring 102 by way of piston rod 144 and piston rod connector 145. The outer ring 102 rotates in a stationary circle around the stationary outer ring support column. The entire inner disk 106, containing the example five cylinders (not all shown), also rotates in a stationary circle around the axis defined by the centerline 174 of the stationary inner disk support column 124. The transfer gears 164 and 166, transfer shaft 167 (inside transfer shaft housing 169, inner disk gear 170 and outer ring gear 172, detailed in FIG. 6, also impart a rotational motion to the inner disk 106 that exactly matches the rotation speed of the outer ring 102.

Since the rotation of the inner disk 106 is offset from the centerline 176 of the outer ring center support column 162, as shown in FIG. 3, the distance of the inner disk 106 to the outer ring 102 remains constant, since neither outer ring center support column 162, offset casting 180, nor inner disk support column 124 rotate, but rather remain fixed. As also shown in FIG. 3, cylinders, such as cylinder 112, are mounted between the upper plate 128 and lower plate 130 of the inner disk 106. The pistons, such as piston 125 and piston 159, have a relative movement with respect to the cylinders, such as cylinders 108, 112 because of the offset position of the inner disk 106 with respect to the outer ring 102, as the inner disk 106 and the outer ring 102 rotate together. As shown in FIG. 3, piston 125 is in a maximum compression state while piston 159 is in a maximum expansion state. Piston 159 is in a maximum expansion state, since the inner-disk support column 124 is offset in a direction (to the left in FIG. 3) away from piston 159. The maximum compression of piston 125 occurs because the inner disk 106 is offset in a direction (left) by a maximum amount toward piston 125. These distances change as the inner disk 106 and outer ring 102 rotate around the inner disk support column 124 and outer ring support column 162, respectively. This is explained in more detail with respect to FIGS. 4A-4E.

Figure 4A:
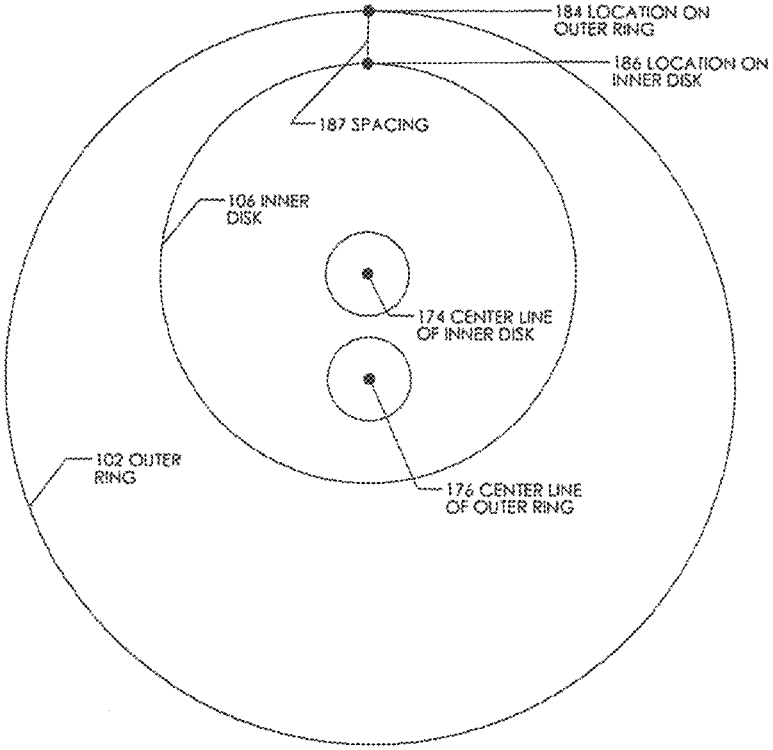
FIGS. 4A-4E are schematic top-down views illustrating the offset rotations of the outer ring and inner disk.

FIG. 4A is an exaggerated schematic illustration showing the manner in which the inner disk 106 and the outer ring 102 rotate together. As shown in FIG. 4A, there is a location 186 on the inner disk which faces a location 184 on the outer ring. In the offset rotational internal combustion engine 100, the location 184 on the outer ring 102 indicates the location for the attachment of a piston, while location 186 on the inner disk 106 indicates the location of a cylinder on the inner disk 106. The inner disk support column 124 has a centerline 174 that the inner disk 106 rotates around. Similarly, outer ring 102 has a centerline 176 which the outer ring rotates around. The centerline 174 of the inner disk 106 is offset from the centerline 176 of the outer ring 102, as illustrated in FIG. 4A. The offset centerlines 174, 176 create a spacing 187*a* between the location 184 of the outer ring 102 and location 186 on the inner disk 106. The inner disk support column 124 (FIG. 1) remains stationary while the inner disk 106 rotates around the inner disk support column 124 and the centerline 174. The inner disk 106 and outer ring 102 rotate so that the location 186 is more or less aligned with location 184 and the centerline 176 of the outer ring 102. In this manner, the location 184 on the outer ring 102 and the location 186 on the inner disk 106 come closer to each other, or go farther apart, as inner disk 106 and outer ring 102 rotate. The disks rotate in the direction shown by the arrows. This change from 187*a* to 187*e* is illustrated more clearly in FIGS. 4B-4E. By these movements expansion and contraction occur within the cylinders even though the pistons show non-reciprocal movement and cause no vibration.

Figure 4B:
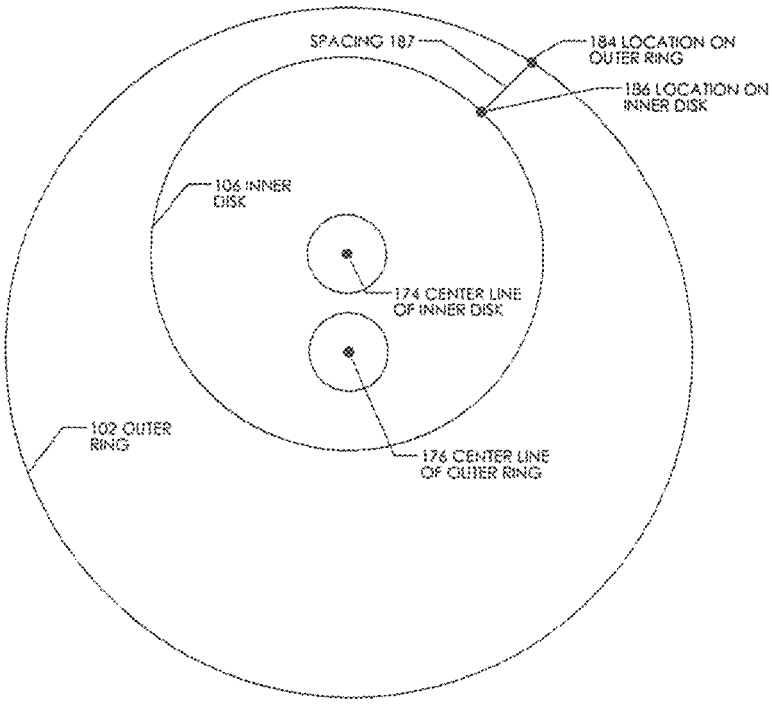

FIG. 4B is a schematic illustration of the outer ring 102 and the inner disk 106 rotated 45° in the direction of the arrows from the locations illustrated in FIG. 4A. As shown in FIG. 4B, the location 184 on outer ring 102 is somewhat farther from the location 186 on the inner disk 106 because of the offset of centerline 174 of inner disk 106 from centerline 176 of outer ring 102. As shown in FIG. 4B, the outer ring 102 and the inner disk 106 have been rotated by approximately 45° and the rotational angle of the inner disk 106 and the outer ring 102 is such that location 184 is somewhat more distant from location 186 because of the effect of the offset. The inner-disk support column 124 (FIG. 1) and the outer ring support column 162 (FIG. 2) have not rotated or changed spacing distance, but rather, the inner disk 106 has rotated around the inner disk support column 124, and the outer ring 102 has rotated around the outer support column 162, which are offset by the distance between centerline 174 and centerline 176. As shown in FIG. 4B, the spacing 187*b* has increased from the spacing 187*a* illustrated in FIG. 4A because of the offset rotation of the inner disk 106 relative to rotation of the outer ring 102.

Figure 4C:
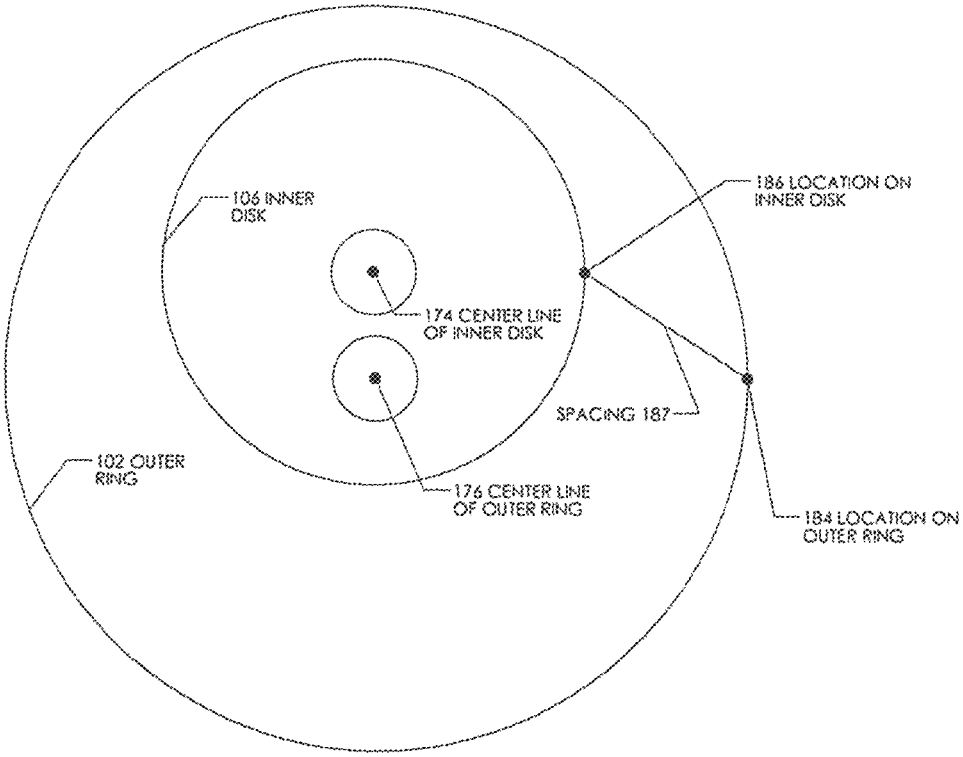

FIG. 4C illustrates the outer ring 102 rotated in the direction of the arrows, so that location 184 on outer ring 102 is approximately 90° on the centerline 176 of the outer ring support column 162 (FIG. 2). Location 186 is aligned with the centerline 176 and adjacent to the location 184 on the outer ring 102. The spacing 187*c* between the location 184 on the outer ring 102 and location 186 on the inner disk 102, however, is even larger than the spacing illustrated in FIGS. 4A and 4B. This is because of the offset of the centerline 176 of the outer ring support column 162 and the centerline 174 of the inner disk support column 124.

Figure 4D:
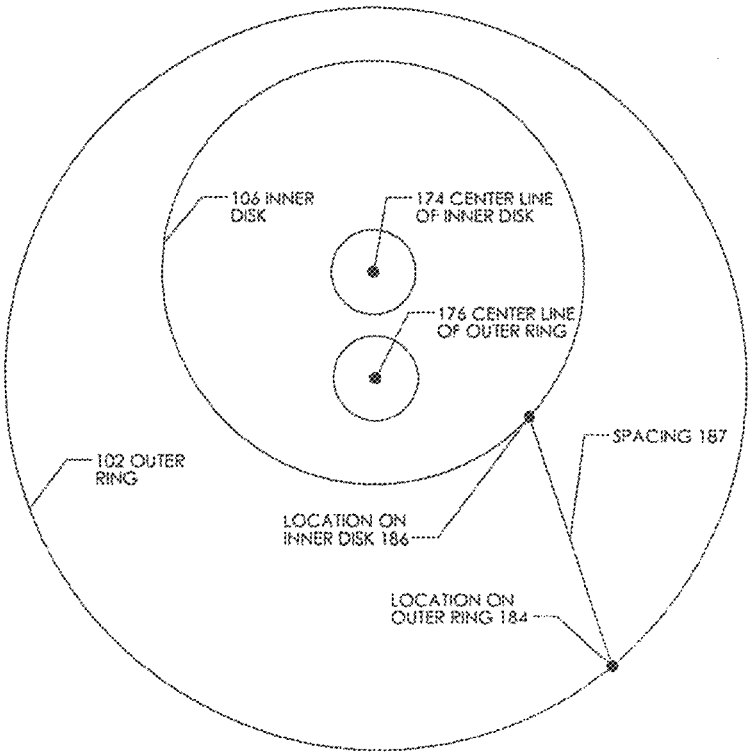

FIG. 4D illustrates the rotations of the outer ring 102 and inner disk 106, so that the locations of 184 on the outer ring 102 and 186 on the inner disk are both approximately 135° away from their vertical positions shown in FIG. 4A. As illustrated in FIG. 4D, the spacing 187*d* has become progressively larger than the spacing in FIGS. 4A, 4B and 4C. This is the result of the offset of the centerline 176 of the outer ring support column 162 from the centerline 174 of the inner-disk support column 124 (FIG. 1).

Figure 4E:
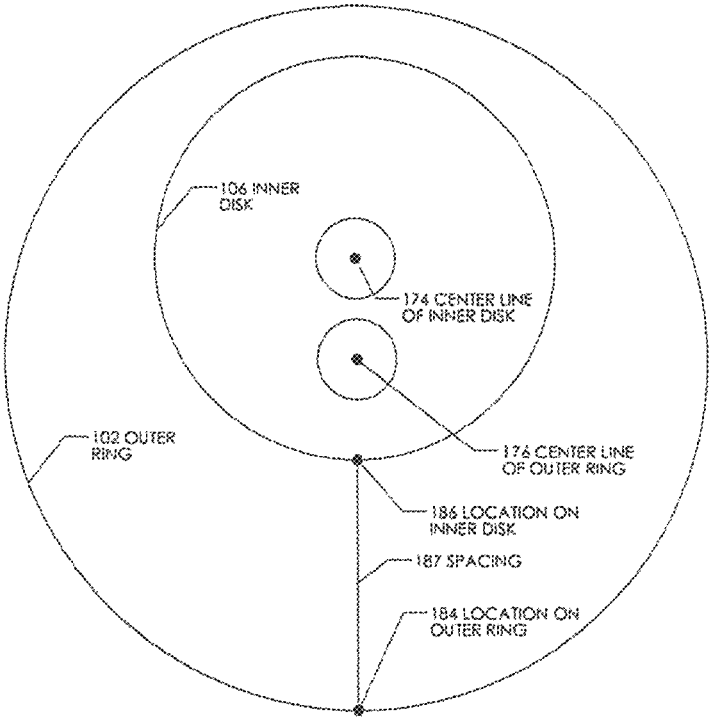

FIG. 4E is an illustration of the rotations of the outer ring 102 and inner disk 106, such that the locations 184 on the outer ring 102 and 186 on the inner disk are 180° from the location 184 illustrated in FIG. 4A. In this manner, the locations 184 & 186 are now aligned to show twice the distance of the offset. As shown in FIG. 4E, the spacing 187*e* is the maximum spacing between the locations 184 & 186, as a result of the offset of the centerline 176 of the outer ring support column 162 and the centerline 174 of the inner disk support column 124 (FIG. 1).

Accordingly, as shown in FIGS. 4A-4E, the outer ring 102 rotates around the centerline 176 of the outer ring support column 162 (FIG. 1.) and the pistons that are attached to the outer ring 102, as illustrated in more detail below in FIG. 5A-5E, do not reciprocate, but rather just move in a circular motion defined by the circumference of the outer ring 102. Similarly, the inner disk 106 simply rotates around the centerline 174 of the inner disk support column 124 (FIG. 1) in a circular motion. The cylinders and other devices connected to the inner disk 106 do not reciprocate, but rather simply spin in a circular motion around the inner disk support column 124. As illustrated in FIGS. 5A-5E, the pistons that are mounted on the outer ring 102 move in and out of the cylinders that are mounted on the inner disk 106 because the spacings 187*a* to 187*e* change as the outer ring 102 and inner disk 106 rotate in the direction of the arrows. In this manner, the pistons show essentially non-reciprocal motion because of the offset rotational internal combustion engine 100 that is illustrated in FIG. 1. The offset axes defined by the respective centerlines 174 and 176 of the inner disk 106 and the outer ring 102 provide the relative movement between the pistons that are connected to the outer ring 102 and the cylinders that are mounted on the inner disk 106.

FIGS. 5A-5E are similar to FIGS. 4A-4E, in that both sets of figures show the rotation of the outer ring 102 and inner disk 106 through a 180° revolution. FIGS. 5A-5E show the manner in which the piston 159 is connected to the outer ring 102 via a piston rod 144. FIGS. 5A-5E also show the mounting of a cylinder 112 on the inner disk 106. For clarity purposes, only a single piston 159 and a single cylinder 112 are illustrated. However, the example embodiment illustrated in FIGS. 1-3 utilizes five pistons and five cylinders for beneficial operation. In this regard, it is beneficial to have an odd number of pistons/cylinders in the offset rotational non-reciprocating-piston internal combustion engine 100 for timing of the compression and expansion of the pistons on the cylinder, thereby creating a 4-cycle engine. FIGS. 5A-5E show the location of just one piston 159 and cylinder 112 at 45° intervals, up to 180°.

Figure 5A:
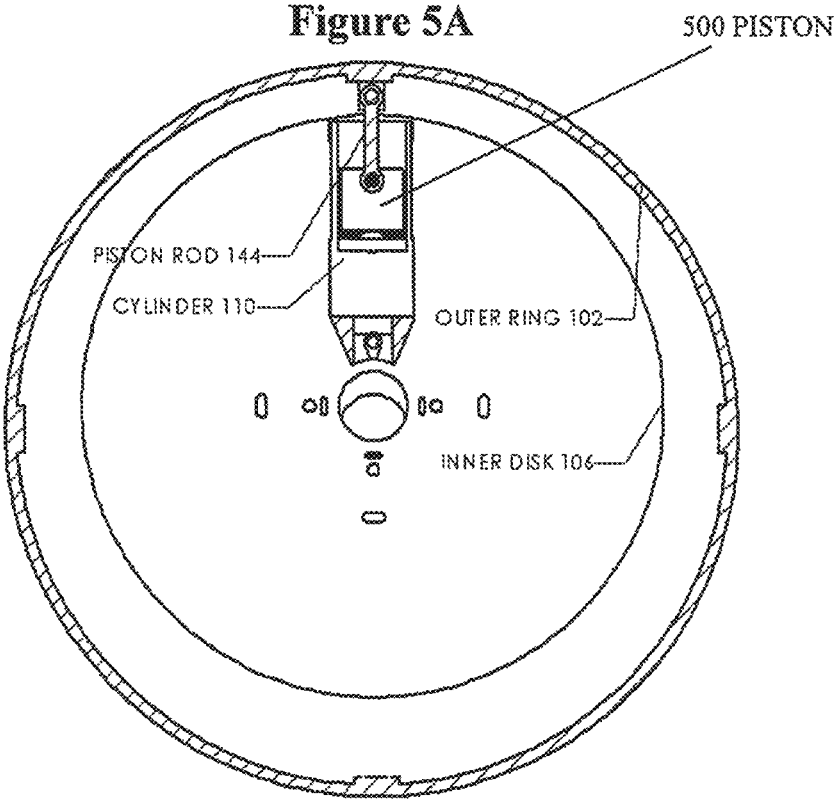
FIG. 5A-5E are schematic top-down views illustrating the rotation of the outer ring and inner disk and the manner in which the pistons cause compression in the cylinders.

As illustrated in FIG. 5A, the inner disk 106 is offset toward the top of the figure. In this position, piston 159 extends the maximum distance into the cylinder 112 during the movement of the outer ring 102 and the inner disk 106 in the 360° revolution of the outer ring 102 and inner disk 106 in the direction of the arrows. In the position shown in FIG. 5A, there is maximum compression of the air/fuel mixture by piston 159 within cylinder 112.

Figure 5B:
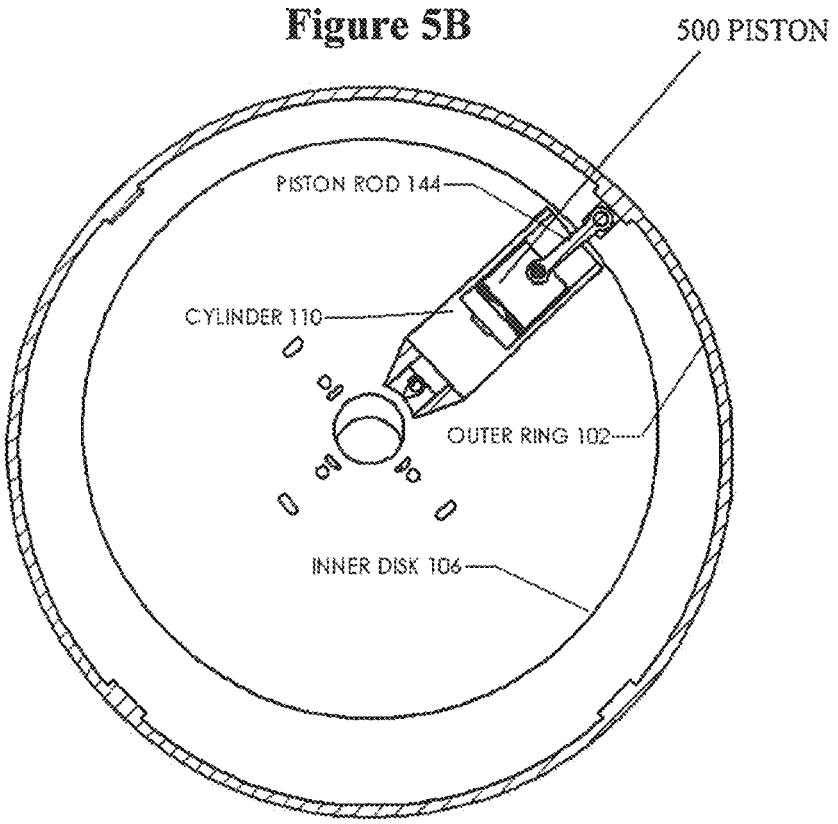

FIG. 5B illustrates the outer ring 102 and inner disk 106 rotated by approximately 45° in the direction of the arrows. As illustrated in FIG. 5B, the expansion of the ignited air/fuel mixture creates a high-pressure between the piston 159 and the end (i.e., the cylinder head 212) of cylinder 112, which generates a force vector in the direction of rotation.

Figure 5C:
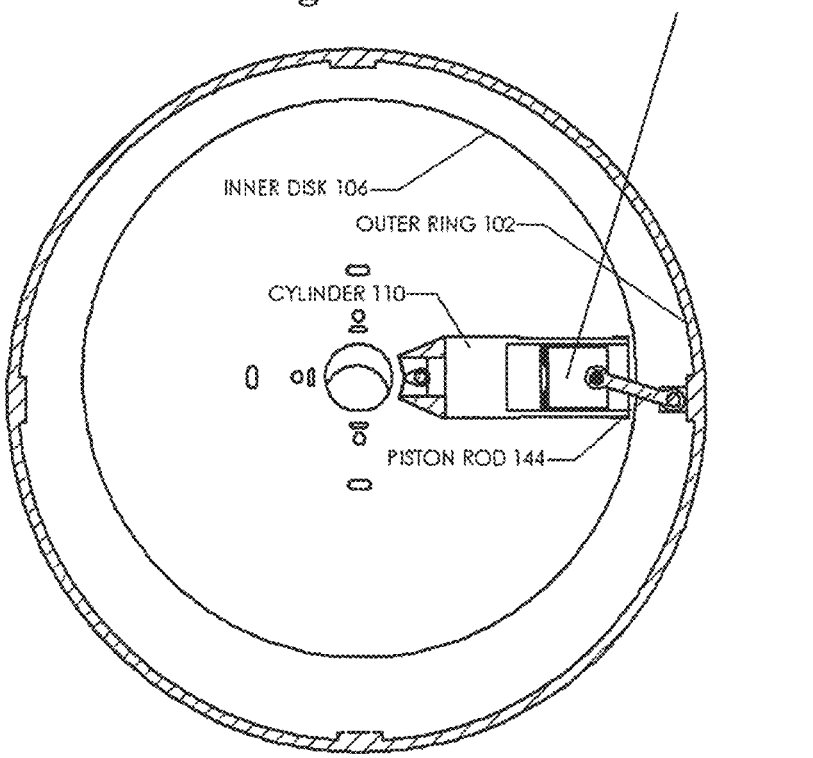

As illustrated in FIG. 5C, the outer ring 102 and inner disk 106 have rotated to the 90° position. The piston rod 144 is slightly offset because of the displacement of the inner disk 106 relative to the outer ring 102. At the 90° position, illustrated in FIG. 5C, piston 159 has extended approximately half of the distance into cylinder 112.

Figure 5D:
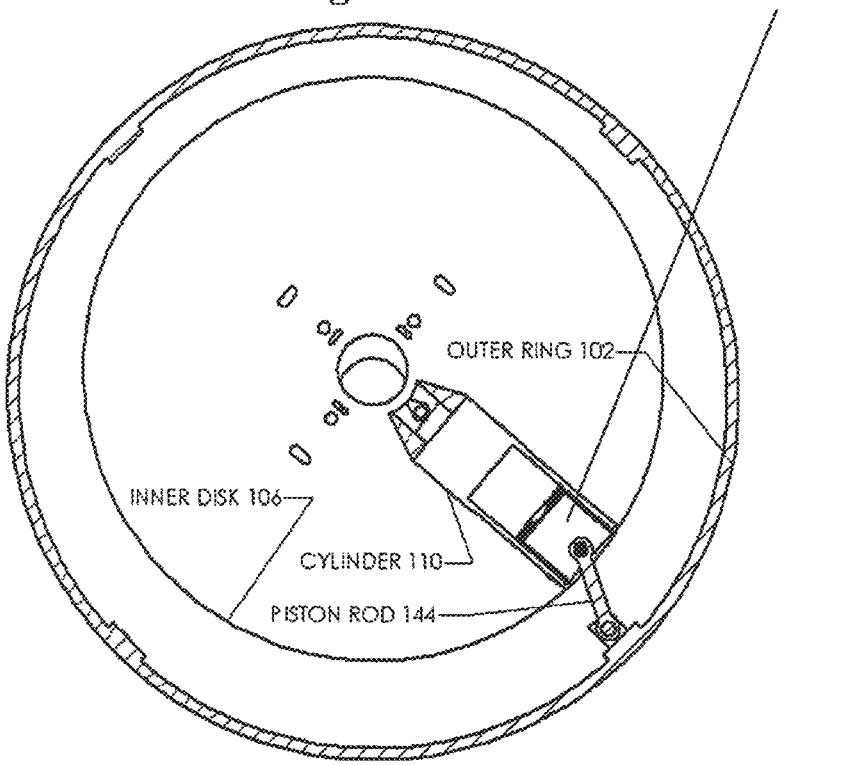

FIG. 5D illustrates the rotation of the outer ring 102 and inner disk 106 to the 135° angle. As shown in FIG. 5D, piston 159 has extended approximately three-quarters of the distance of its total travel into cylinder 112.

Figure 5E:
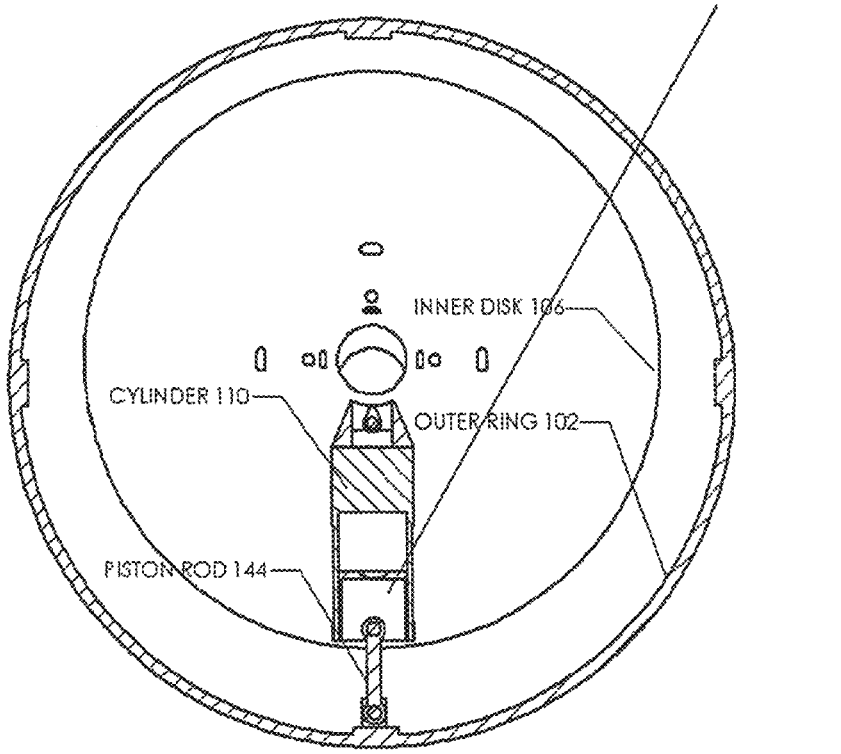

FIG. 5E illustrates the outer ring 102 and inner disk 106 rotated approximately 180°. As shown in FIG. 5E, the piston 159 is extended the maximum distance into cylinder 112. This is a result of the offset between the inner disk 106 and the outer ring 102. This process continues past 180° in a compression cycle until the disks rotate hack to the 0° position, illustrated in FIG. 5A. Again, the compression- and expansion-effects of piston 159 in the cylinder 112 occurs because of the relative offset of the inner disk 106 to the outer ring 102. The inner disk 106 simply rotates around centerline 174 (FIGS. 4A-4E) of the inner disk support column 124 (FIG. 1). The inner disk support column 124 does not rotate, but rather, the inner disk 106 rotates around the inner disk support column 124. Accordingly, there is little or no vibration created by the movement of the inner disk 106, especially when the components mounted on the inner disk 106 are balanced and evenly dispersed across the inner disk. The same is true for the outer disk. The pistons do not reciprocate with respect to the outer ring 102, but simply rotate with the outer ring and drive the outer ring in the circular motion. The outer ring simply rotates on the centerline 176 of the outer ring support column 162. (FIG. 2). Neither outer ring support column 162 nor inner disk support column 124 rotate. None of these items create vibration in the engine. There is a slight radial movement of the piston in relation to the outer ring 102 due to the changing angle of the piston rod in relation to the outer ring 102, but that slight radial movement is not considered to be a reciprocating piston in the sense of reciprocating pistons in conventional reciprocating piston internal combustion engines.

In FIGS. 5A-5E the explosive-expansion cycle of the four-cycle engine is shown. As the inner disk 106 and outer ring 102 continue rotating back to the 0° position, the exhaust cycle occurs. As the expansion cycle shown in FIGS. 5A-5E repeats, the air/fuel intake cycle occurs. As the rotating disk and ring return to the 0° position again the compression cycle occurs. The engine is then set up to start the explosive-expansion cycle again.

In FIGS. 5A-5E, only the explosive-expansion phase is shown. In normal operation of this phase is followed by the exhaust phase as the first 360° circle ends. The second 360° circle begins with the air-intake phase and ends with the compression phase.

Figure 6:
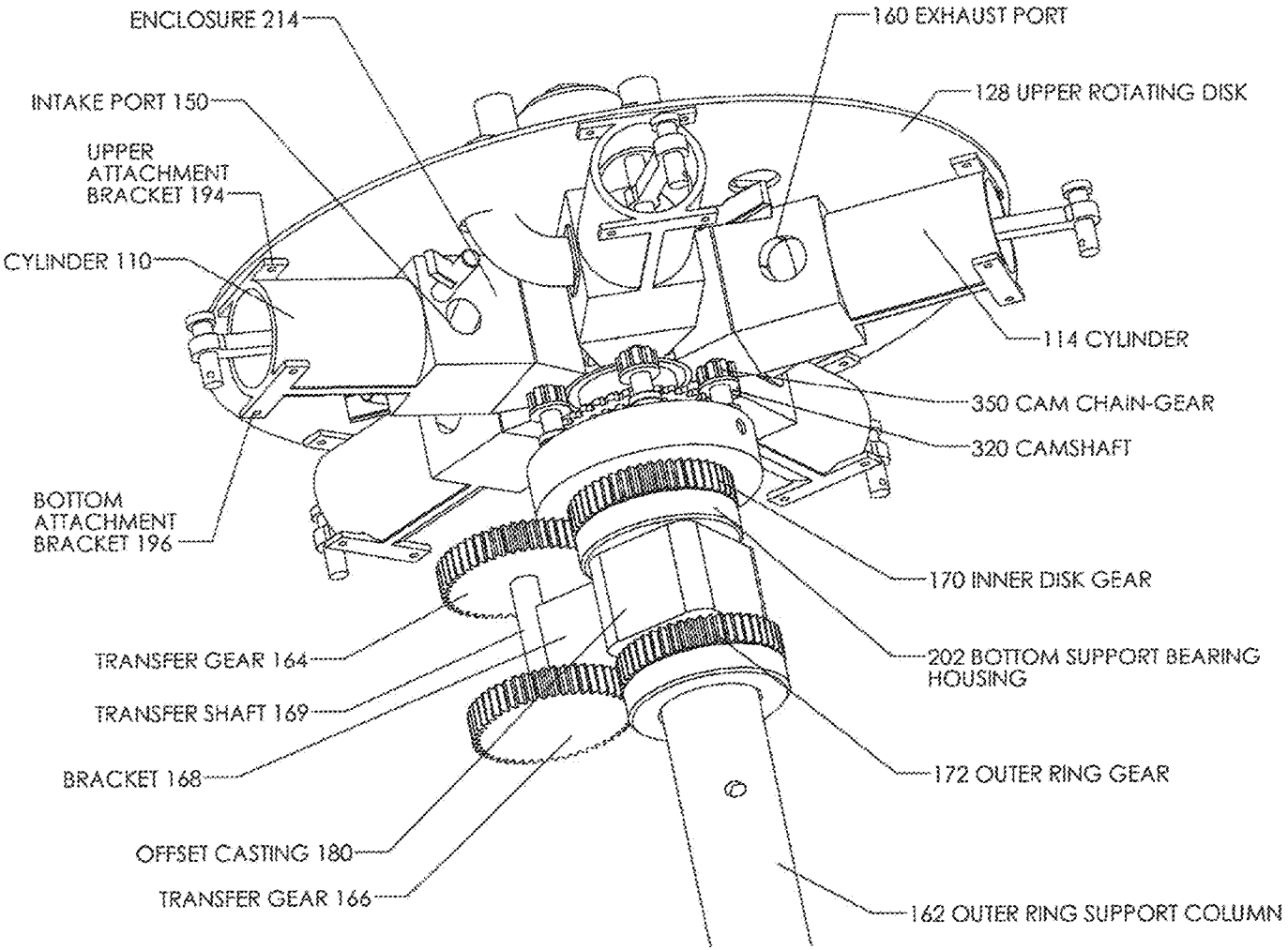
FIG. 6 is an additional isometric view of portions of the embodiment of FIG. 1.

FIG. 6 is another isometric view of various components of the embodiment of the offset rotational non-reciprocating-piston internal combustion engine 100. As shown in FIG. 6, cylinder 110 is attached to the upper rotating plate 128 by way of upper attachment bracket 194, Bottom attachment bracket 196 of cylinder 110 is attached to the lower rotating plate 130 (FIG. 2). Each of the cylinders, such as 110 and 114, have upper and lower attachment methods, such as the brackets shown, to attach the cylinders, 110 and 114, to the upper plate 128 and the lower plate 130 (FIG. 2), respectively. FIG. 6 also illustrates the bottom of camshafts 320 and valve spring enclosures 214 that enclose the camshafts, valve stems, and springs. Similar enclosures are provided for each of the cylinders of the example offset rotational internal combustion engine 100. Intake port 150 provides combustion air to the cylinder 110. An exhaust port 160 provides a port in the camshaft valve enclosure 214 for cylinder 114, which is representative of the camshaft valve enclosures for the other cylinders as well. The camshaft valve enclosure is attached to the inner end, i.e., to the cylinder head 212 (see FIG. 7), of cylinder 114, to move the exhaust out of cylinder 114. Camshaft 320 has a camshaft chain gear 350 that drives the camshaft 320 via the camshaft chain (not shown). Camshaft 320 rotates in the camshaft, valve spring enclosure 214 that is attached to cylinder 114.

Figure 23:
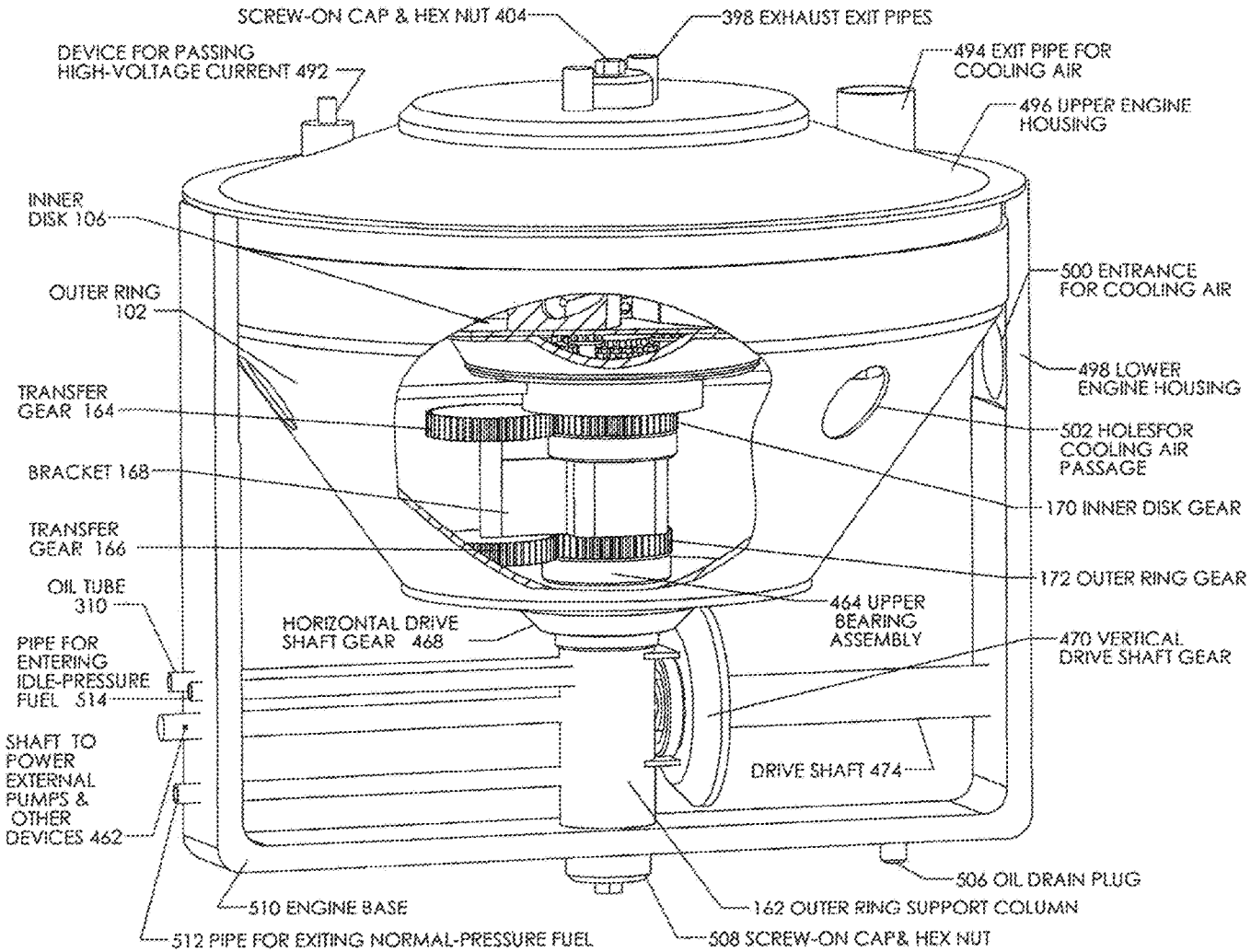
FIG. 23 is an isometric view of an embodiment of the offset rotational non-reciprocating-piston internal combustion engine.

Also depicted in FIG. 6 is the gear arrangement that assures that the inner rotating disk 124 (FIG. 1) and the outer ring 102 (FIG. 1) rotate at exactly the same speed. Inner disk gear 170 is connected to the lower rotating plate 130 (FIG. 2) so that the inner disk gear 170 rotates with the inner disk 106 (FIG. 2). Outer ring center-support-column 162 is stationary and is connected to the offset casting 180. As such, the offset casting 180 also does not rotate. Bracket 168 is connected to the stationary offset casting 180 and to the housing for the transfer shaft 167 (shaft 167 not shown). Transfer shaft 167 comprises a shaft within the housing that is connected to the bracket 168, Bracket 168 is attached to offset casting 180. Transfer shaft 167 (not shown) connects transfer gear 164 to transfer gear 166. Transfer gear 164 is coupled to the inner disk gear 170, so that transfer gear 164 rotates with the inner disk gear 170. Transfer gear 166 is coupled to outer ring gear 172. Since transfer gear 166 is also coupled to transfer gear 164, they both rotate at the same speed. Since transfer gear 166 is coupled to the outer ring gear 172, rotation of the transfer gear 166 also causes rotation of the outer ring gear 172. Consequently inner-disk gear 170 and outer-ring gear 172 both rotate at the same speed. Of course, bearings are provided between the stationary center-support columns 124 and 162 the inner disk gear 170 and the outer ring gear 172, so that they can rotate around the columns at high speed with minimal friction. The rotational mechanical energy from outer ring gear 172 is transferred to additional gears, which drive a driveshaft, as illustrated in FIG. 23.

Figure 7:
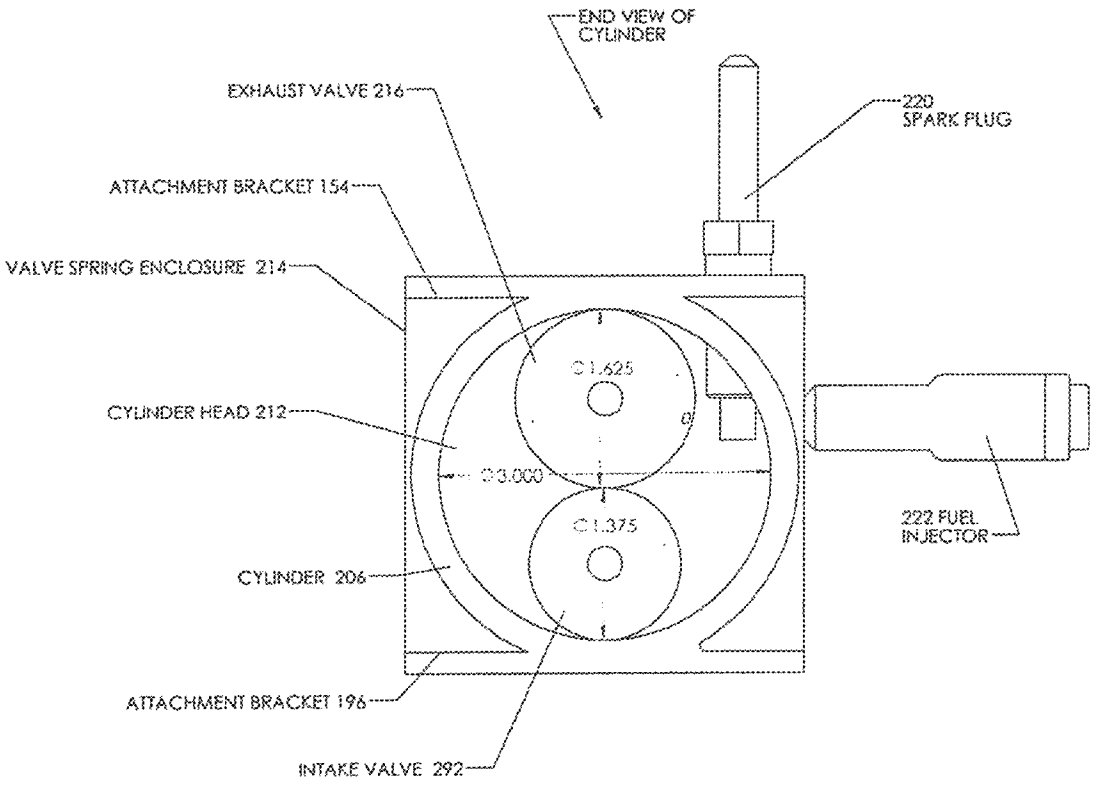
FIG. 7 is an end view of an embodiment of a cylinder.

FIG. 7 is an end view looking inside a cylinder (e.g., 210) from the outside while looking toward the center of the inner disk 106 without a piston present in cylinder 210. As shown in FIG. 7, upper attachment bracket 154 and lower attachment bracket 196 are attached to the cylinder 210. Intake valve 292 and exhaust valve 216 are seated in the cylinder head 312. Spark plug 220 is threaded into the interior of the cylinder 206 to ignite the compressed fuel/air mixture. Fuel is injected through fuel injector 222 into the interior of the cylinder 206. Since the fuel injector 222 includes a solenoid, to open the fuel line there has to be a control wire (not shown) that sends a control signal to open and close the fuel injector 222. A single control device can activate both the solenoids and the spark plugs. The timing of the ignition of the spark plugs can be coordinated with the camshaft timing, or from positions on the driveshaft. Valve-spring enclosure 214 sits behind cylinder head 212.

Figure 8:
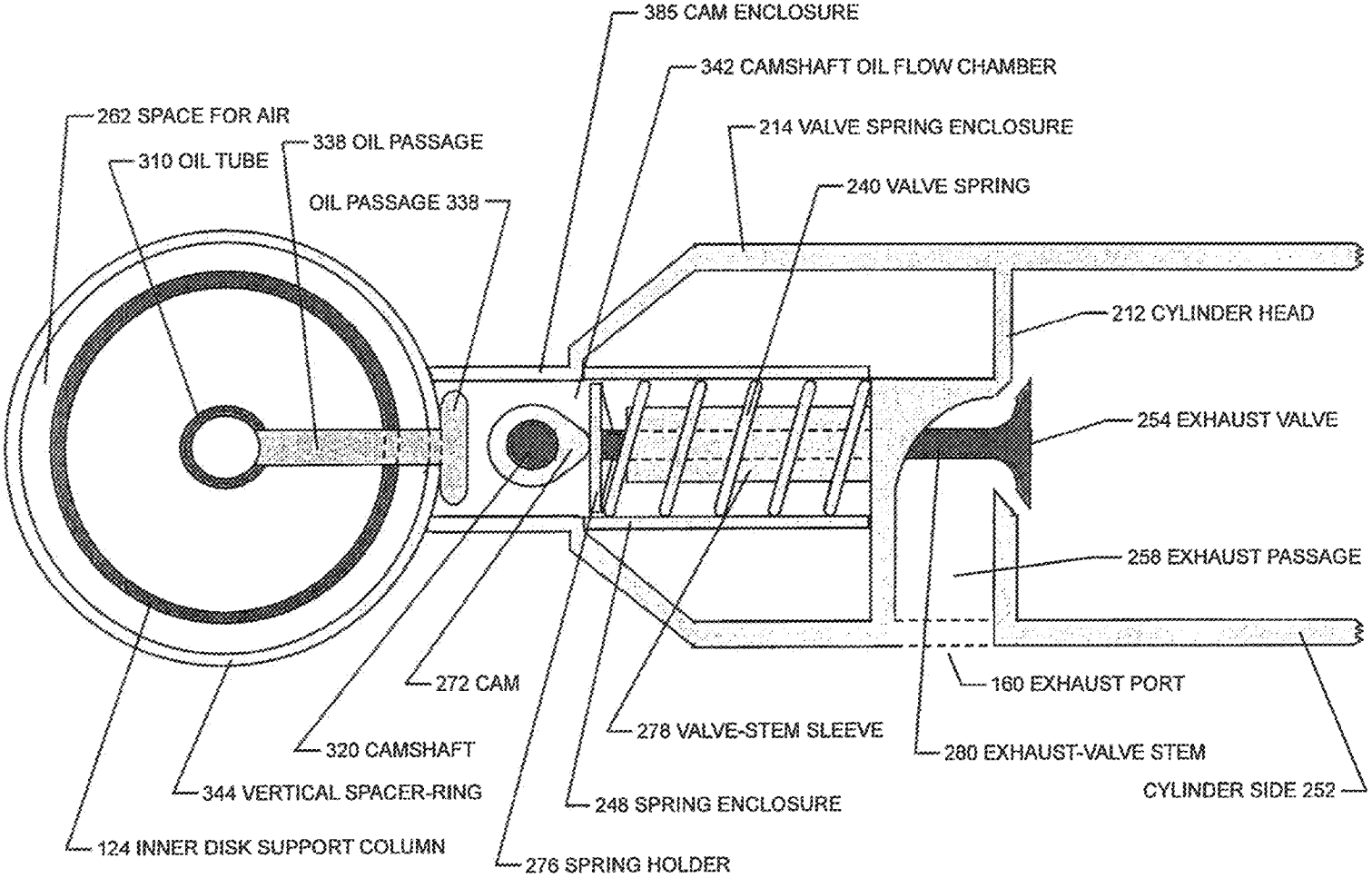
FIG. 8 is a schematic illustration of an embodiment illustrating the operation of a cam and exhaust valve.

FIG. 8 is a top-down view of a portion of cylinder 206 and the inner disk support column illustrating oil flow and the operation of the cam and valve system. As shown in FIG. 8, the inner disk support column 124 includes an oil tube 310. An oil passage 338 is connected to the oil tube, which allows oil to flow into the camshaft chamber 342 (by passing down through upper rotating plate 128) to lubricate the cam 272 and camshaft 320 (also shown in FIG. 10). Oil flow is assisted by centrifugal force on the oil created by rotation of the inner disk 106 (FIG. 1). As also illustrated in FIG. 8, vertical spacer ring 344, that surrounds the inner disk support column 124, creates a protected space 262 for cooling air between the inner disk support column 124 and the heat generated by the exhaust gas. The camshaft 320 is shown rotated so that the cam 272 compresses the exhaust valve stern 280, so that the exhaust valve 254 is separated from the exhaust valve seat and is open in the cylinder 210. Exhaust flows around the exhaust valve to the exhaust passage 258 and out through the exhaust port 160. Valve spring 240 presses against the spring holder 276 and normally keeps the exhaust valve 254 in a closed position. However, when the cam 272 is rotated by the camshaft 320 to the position illustrated in FIG. 8, the valve spring 240 is compressed. The exhaust valve stem 280 is pushed through the valve stern sleeve 278 in the valve spring enclosure 248 to the open position illustrated in FIG. 8. As the camshaft 320 is rotated, the earn 272 allows the valve spring 240 to extend, so that the exhaust valve 254 becomes seated in the cylinder-head 212, so that the exhaust valve 254 is in a seated, closed position.

Figure 9:
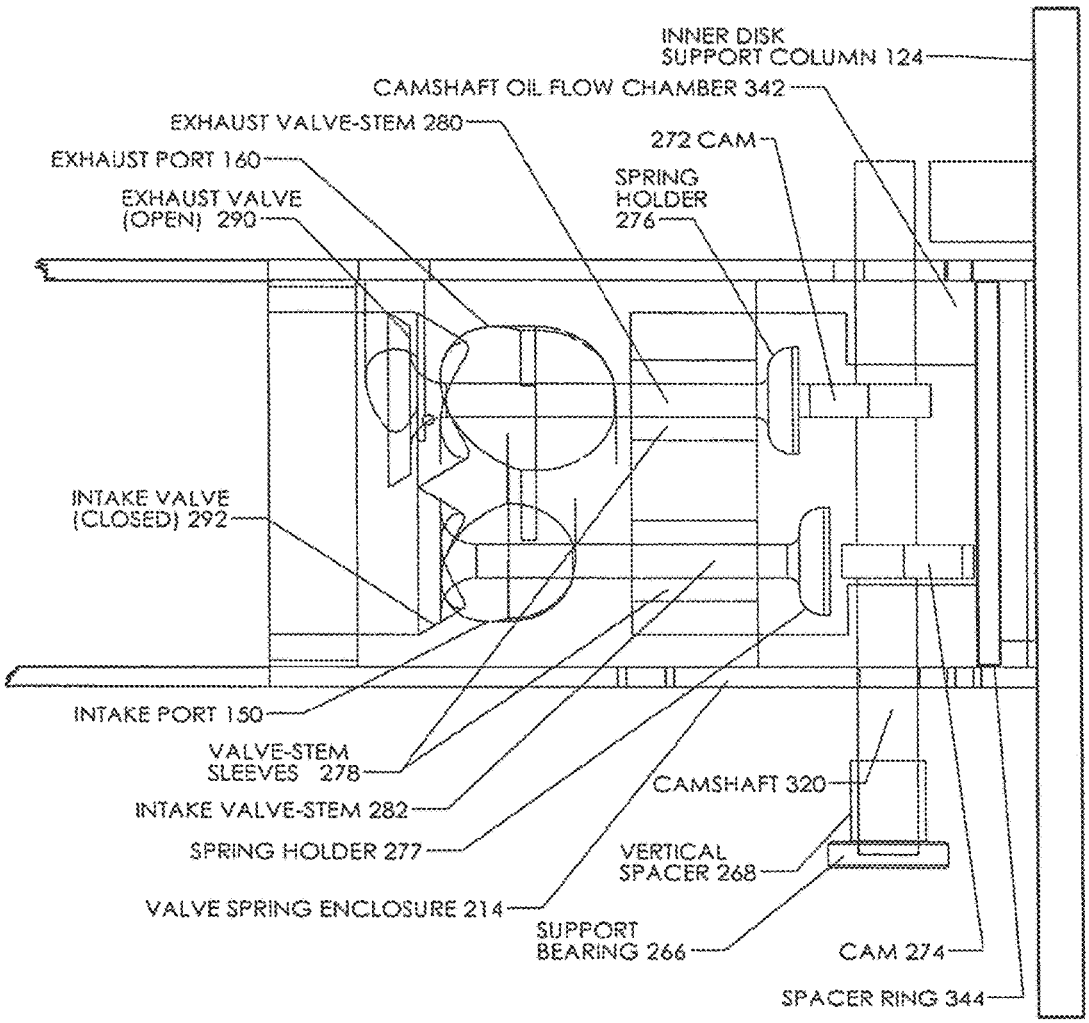
FIG. 9 is a detailed side view of an embodiment of exhaust and intake valves and ports.

FIG. 9 is a detailed side view of the exhaust and intake valves and various ports. As illustrated in FIG. 9, cam 274 interfaces with the spring holder 277. Spring holder 276 is coupled to the exhaust valve stem 280, which extends through the valve stem sleeve 278. The force created by the cam 272 causes the exhaust valve 290 to be in an open position. Exhaust gases then flow through the exhaust port 160. Cam 274 is rotated to a position by camshaft 320, so that cam 274 does not interface with spring holder 277. Camshaft 320 sits in a support bearing 266, which allows rotation of the camshaft 320. Vertical spacer 268 surrounds the camshaft 320. While the exhaust valve 290 is in an open position, as shown in FIG. 9, the intake valve 292 is in a closed position, as also shown in FIG. 9. Since the cam 274 is pointed away from the spring holder 277, the intake valve stem 282 is forced into the closed position by the valve spring, as shown in FIG. 9. The valve spring is not shown. Intake valve stem 282 slides within the valve stem sleeve 278. Intake port 150 provides the fuel/air mixture when the intake valve 292 is in an open position. FIG. 9 also illustrates the spacer ring 344 and the inner disk support column 124.

Figure 10:
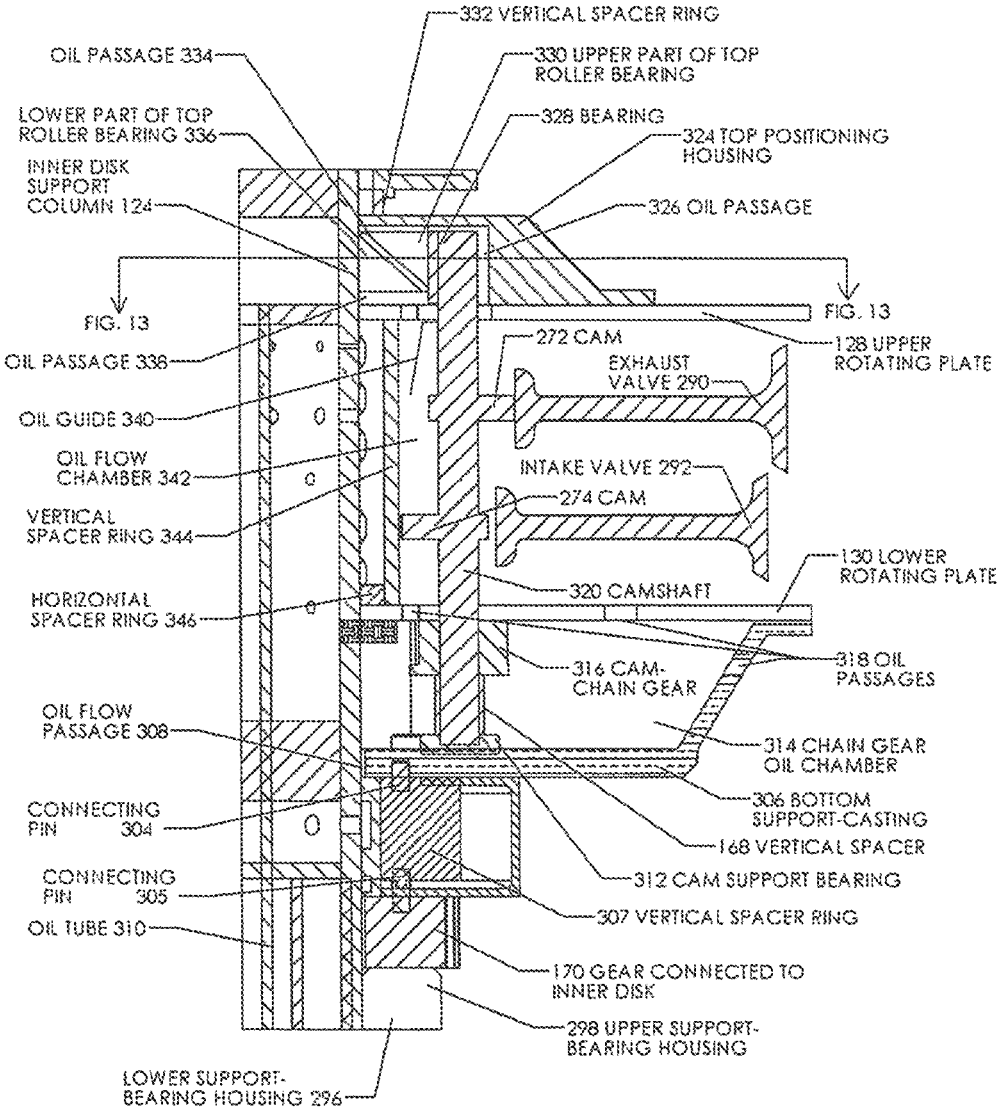
FIG. 10 is a cross-sectional view of an embodiment of the relative positions of spacer rings, camshafts, valves, cam chain gears, upper and lower rotating disks and support castings and bearings.

FIG. 10 is a cross-sectional view illustrating the relative positions of spacer rings, camshafts, valves, cam chain gears, upper and lower rotating disks and support castings and bearings. As illustrated in FIG. 10, going from bottom up, an oil passage 300 provides oil to the bottom roller bearings and is formed between the lower support bearing housing 296 and the upper support bearing housing 298. The lower bearing support housing 296 and the upper bearing support housing 298 are supported vertically by the offset casting 180 (FIG. 3). The lower support bearing housing 296 and the upper support bearing housing 298 support the gear 170, which is connected to the inner disk 106 via bottom support casting 306. Connecting pin 305 connects the vertical spacer ring 307 to gear 170. Connecting pin 304 connects the vertical spacer ring 307 to the bottom support casting 306. An oil flow passage 308 is provided between the inner disk support column 124 and the bottom support casting 306.

Oil tube 310 provides an oil passage in the interior portion of the inner disk support column 124. The camshaft 320 is supported by the cam support bearing 312, which is mounted on the bottom support casting 306. Vertical spacer 168 supports the cam chain gear 316 in the cam gear oil chamber 314. Oil passages 318 in the lower rotating plate 130 and bottom support casting 306 allow oil to flow down into the chain gear oil chamber 314. Cam 272 engages the exhaust valve 290, while cam 274 engages the intake valve 292. The exhaust valve 290 and the intake valve 292 are located between the lower rotating plate 130 and the upper rotating plate 128.

Bearing 328, at the upper end of camshaft 320, supports and positions the camshaft in the top positioning housing 324. An oil passage 334 is provided between the upper part of the top roller bearing 330 and the lower part of the top roller bearing 336. An oil passage 326 takes oil from oil chamber 374 to camshaft 320 so as to lubricate bearing 328, which is located in top positioning housing 324; the oil then flows down into oil-flow chamber 342. Because of centrifugal force, oil-guide 340 is required to assure that oil reaches the cam 272. Vertical spacer ring 344 is positioned adjacent to the inner disk support column 124. Oil passage 338 also provides oil to the oil flow chamber 342. Oil guide 340 guides the oil emitted from the oil passage 338. Vertical spacer ring 344 assures proper spacing between the lower rotating plate 130 and the upper rotating plate 128. Horizontal spacer ring 346 positions the vertical spacer ring 344. Not shown are support rods in between the camshafts that sit atop the bottom support casting 306 and rise vertically to support top positioning housing 324.

Figure 11:
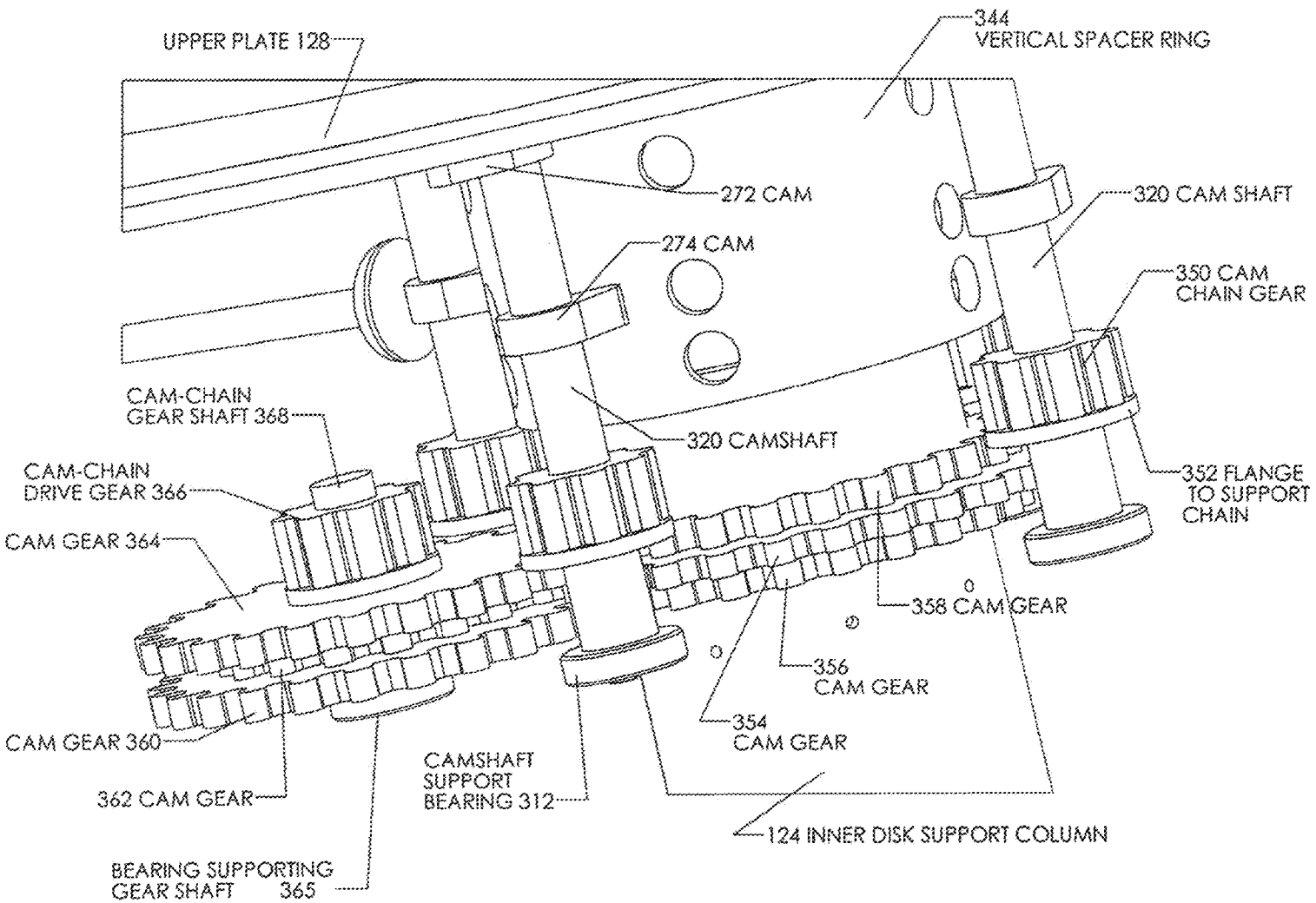
FIG. 11 is a detailed isometric view illustrating an embodiment of the manner in which the camshafts are connected to the inner disk.

FIG. 11 is a detailed view of the camshaft 320 at three locations along with related cam and cam chain gears. As illustrated in FIG. 11, camshaft 320 has cams 272 and 274. A cam chain gear 350 is connected to the camshaft 320. Flange 352 supports the cam chain gear 350 as well as the cam chain (not shown). The camshaft is supported by support bearing 312. Bearing 365 supports the cam chain gear shaft 368. Cam gear 356 is fastened to the inner ring support column 124 and, in this example embodiment, has a diameter of 9 cm. Cam gear 356 drives cam gear 360, which is the same diameter. In this embodiment, for example, cam gear 360 may have a diameter of 9 cm. Cam gear 362 is fastened to cam gear 360 (e.g., single machine part or by casting, welding, riveting, etc.) and rotates at the same speed as cam gear 360. Cam gear 362 is smaller than cam gear 360. In one example embodiment, cam gear 362 has a diameter of 5.666 cm. Cam gear 362 meshes with cam gear 354, which spins freely around the inner disk support column 124. Cam gear 354 may be made to spin at half of the speed of cam gear 362 by having exactly twice the number of teeth as cam gear 362. In one embodiment, cam gear 354 may have a diameter of 11.333 cm (i.e., so it can have twice the number of teeth that gear 362 has). Sitting atop cam gear 354 is cam gear 358, which rotates at the same speed as cam gear 354 because cam gear 358 is fastened to cam gear 354 (they may be the same-machined part or the same casting, or welded together, etc.). Cam gear 358 meshes with cam gear 364, which drives cam-chain drive-gear 366. Cam chain drive gear 366 therefore rotates at half of the speed of the inner disk 106. A bearing may also be provided around the top of the cam chain gear shaft 368, along with an oil source (not shown). The cam chain drive gear 366 drives the cam chain, which is coupled to the cam chain gears 350 on camshafts 320. The other camshafts have similar cam chain gears. The cam chain is not shown in FIG. 11. Because the cam chain gear 366 rotates at half of the speed of the inner disk 106, the intake and exhaust valves open and close every other rotation. This is because the offset rotational non-reciprocating-piston internal combustion 100 is designed as a four stroke engine. For a two stroke engine, only the cam gears 356 and 360 are needed and cam gear 360 can be directly connected to the cam chain drive gear 366. As disclosed, above with respect to FIG. 10, the cam and valve spring oil chamber 342 allows oil to flow down freely—via oil passages 318—into chain-gear oil chamber 314, which encloses the gears illustrated in FIG. 11; the gears illustrated in FIG. 11, therefore, are embedded in a pool of oil.

Figure 12:
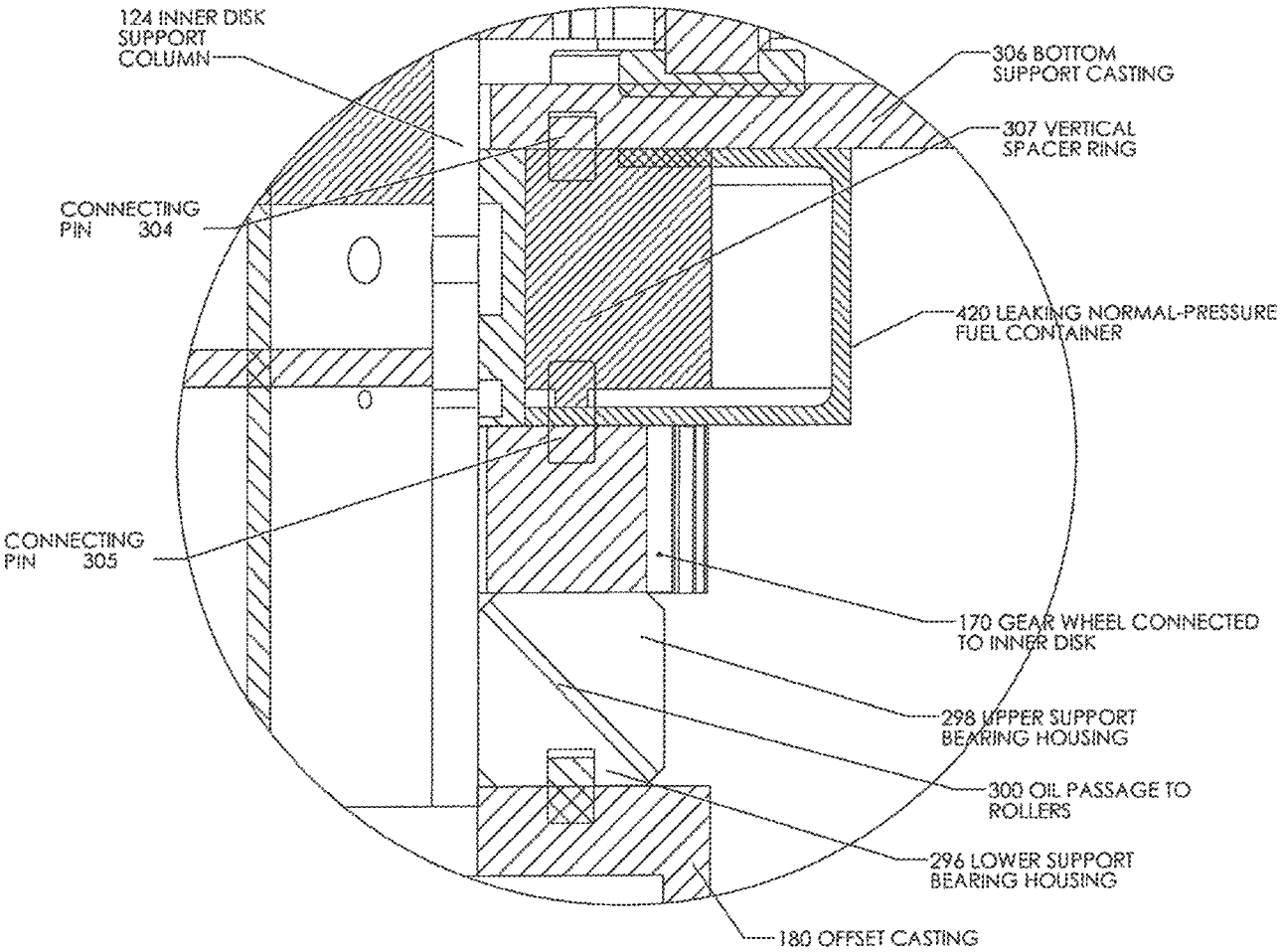
FIG. 12 is a detailed cross-sectional diagram of an embodiment of lower portions of the engine above and below the lower inner disk support bearing.
Figure 18:
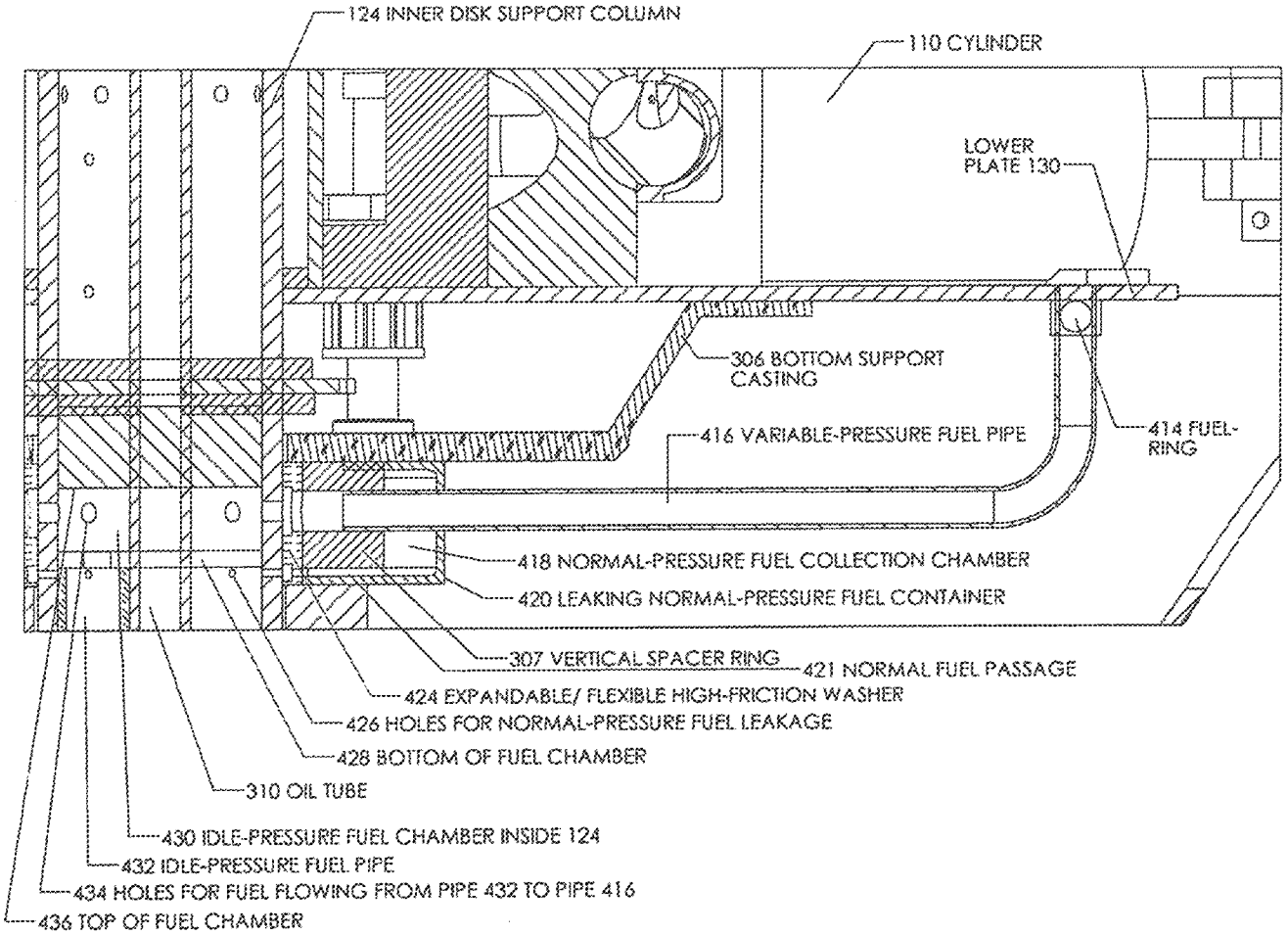
FIG. 18 is a cross-sectional view illustrating an example embodiment of fuel flow and lubrication.

FIG. 12 is a detailed cross-sectional view of parts related to the lower vertical support bearing. An oil passage 300 is provided between the lower support bearing housing 296 and the upper support-bearing housing 298 to lubricate the roller bearings. Gear wheel 170 is connected to the inner disk 106 as follows: Connecting pin 305 connects gear 170 to the vertical spacer ring 307 (and also to the normal-pressure leaking-fuel container 420). Connecting pin 304 connects the vertical spacer ring 307 (and the normal pressure leaking fuel container 420) to the bottom support casting 306. The variable pressure fuel pipe 416, as it passes from fuel container 420 and through spacer ring 307, is depicted in FIG. 18. Elements 170, 298, 306 and 307 rotate around the inner disk support column 124.

Figure 13:
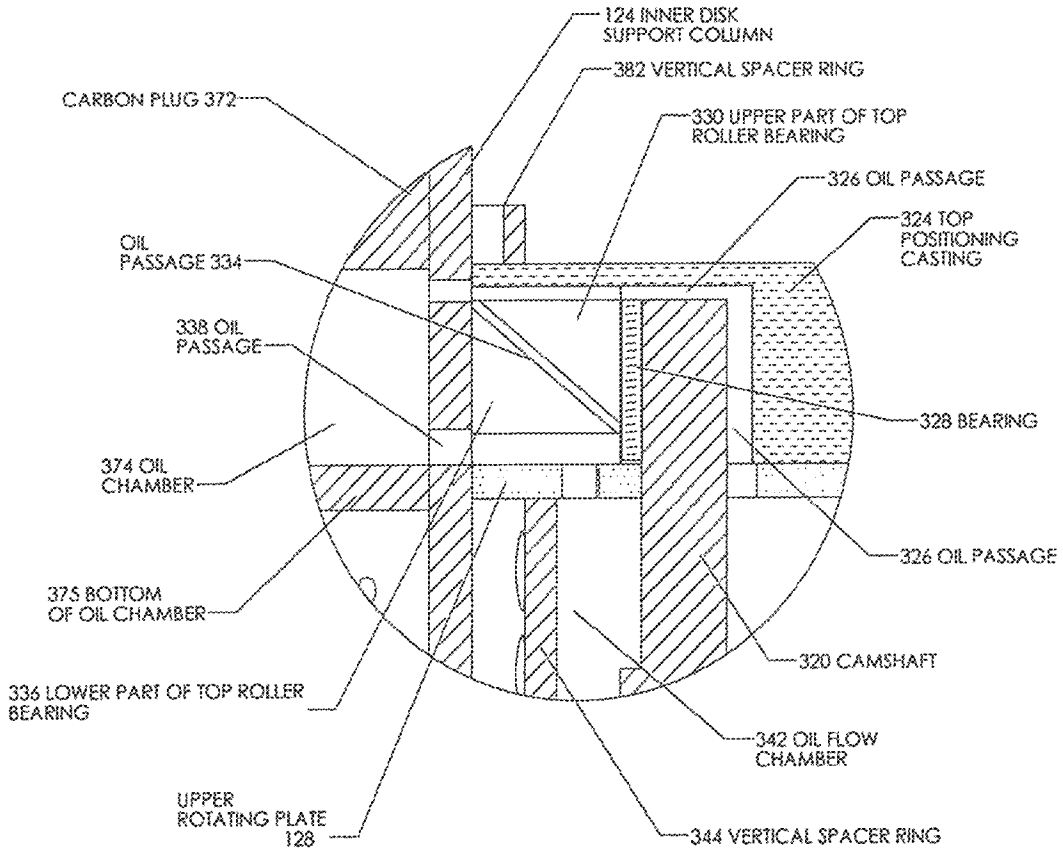
FIG. 13 is a detailed cross-sectional diagram illustrating an embodiment of portions of the engine showing the positioning of the upper inner disk bearing.

FIG. 13 illustrates example details pertaining to the upper bearing housing. As illustrated in FIG. 13, a horizontal spacer ring on top of the upper rotating plate 128 supports the lower portion 336 of the top roller bearing. This support ring is not shown, so that the oil passage 338 can be illustrated in FIG. 13. Oil passage 338 connects the oil chamber 374, which is inside the inner disk support column 124, to oil flow chamber 342. An opening is provided in the upper plate 128 to form this passage. An additional oil passage 326 takes oil from chamber 374 to lubricate camshaft 320, which is positioned against hearing 328, which is positioned by the top positioning casting 324. Vertical spacer ring 344 also forms part of the oil flow chamber 342. Oil passage 326 takes oil from oil chamber 374 to camshaft 320 and positioning bearing 328, and then down to oil-flow chamber 342. Carbon plug 372 forms the upper boundary of the oil chamber 374. The bottom 375 of oil chamber 374 is also depicted. FIG. 13 also illustrates vertical spacer ring 344.

Figure 14:
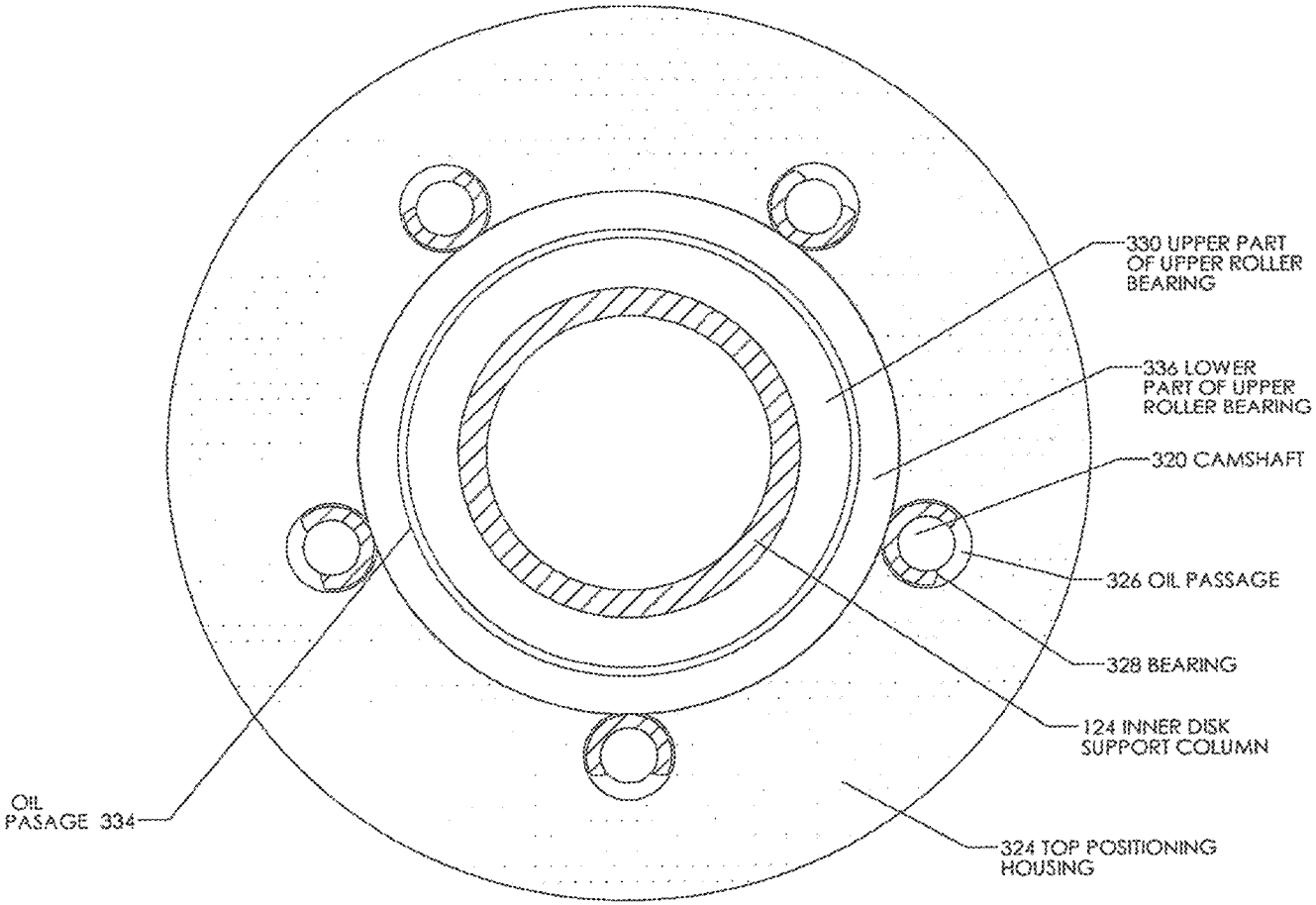
FIG. 14 is the cross-section, from FIG. 10, illustrating an embodiment of the inner disk support column, upper bearing and oil passage.

FIG. 14 is a cross-section from FIG. 10, illustrating the inner disk support column, upper bearing and oil passage. As illustrated in FIG. 14, the inner disk support column 124 is immediately surrounded by the lower part 336 of the upper roller bearing. The oil passage 334 is positioned between the lower part 336 of the upper roller bearing and its upper part 330. FIG. 14 also illustrates the five camshafts, such as camshaft 320, and the five hearings, such as bearing 328. Bearing 328 is a partial bearing, which allows room for an oil passage 326, which lubricates the camshaft. The valve springs provide a force on the camshaft 320, so that the bearing 328 is forced against the lower part 336 of the upper roller bearing. The camshafts 320 are located within the top positioning housing 324.

Figure 15:
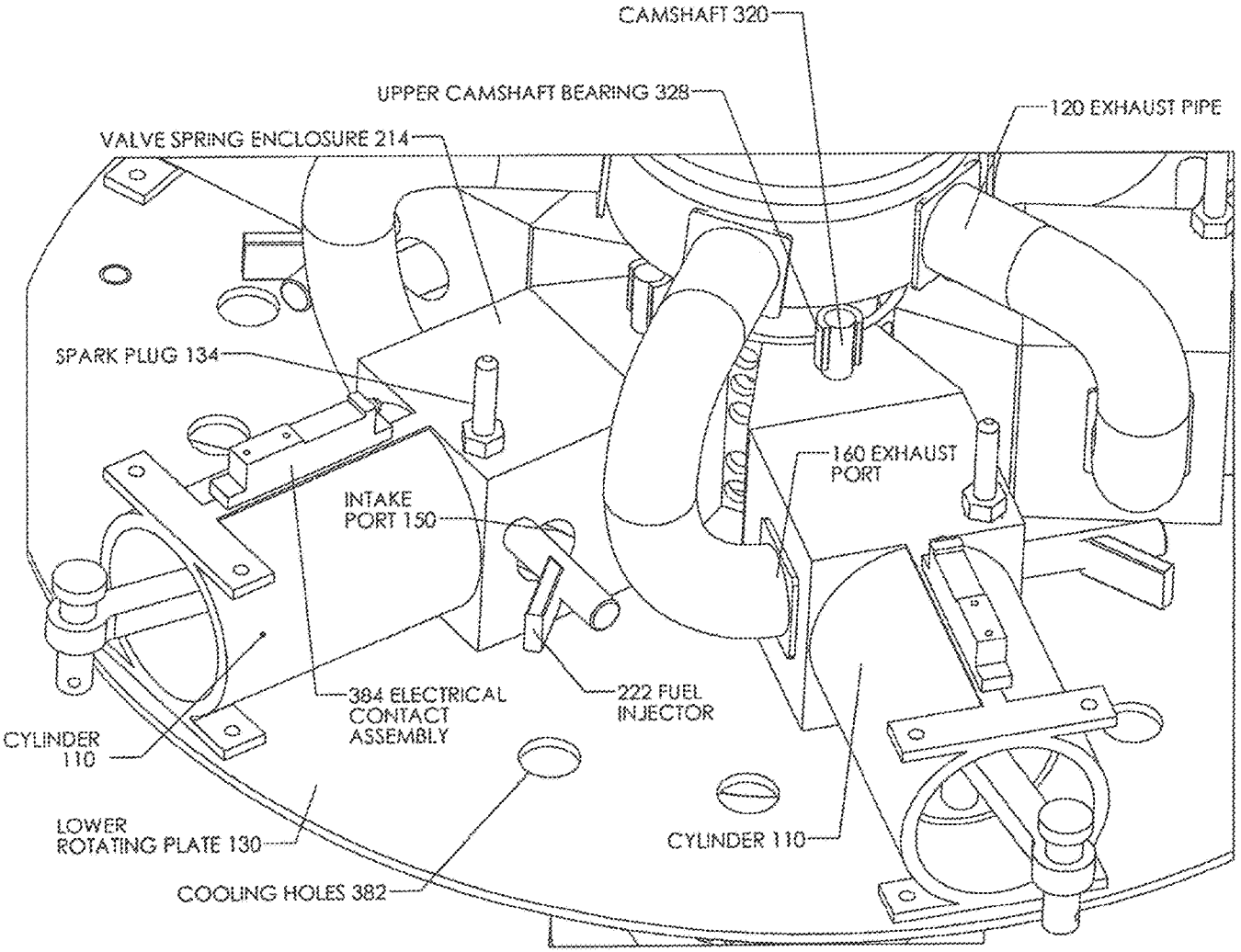
FIG. 15 is an isometric view illustrating an embodiment of example elements of various components located within the inner disk.
Figure 20:
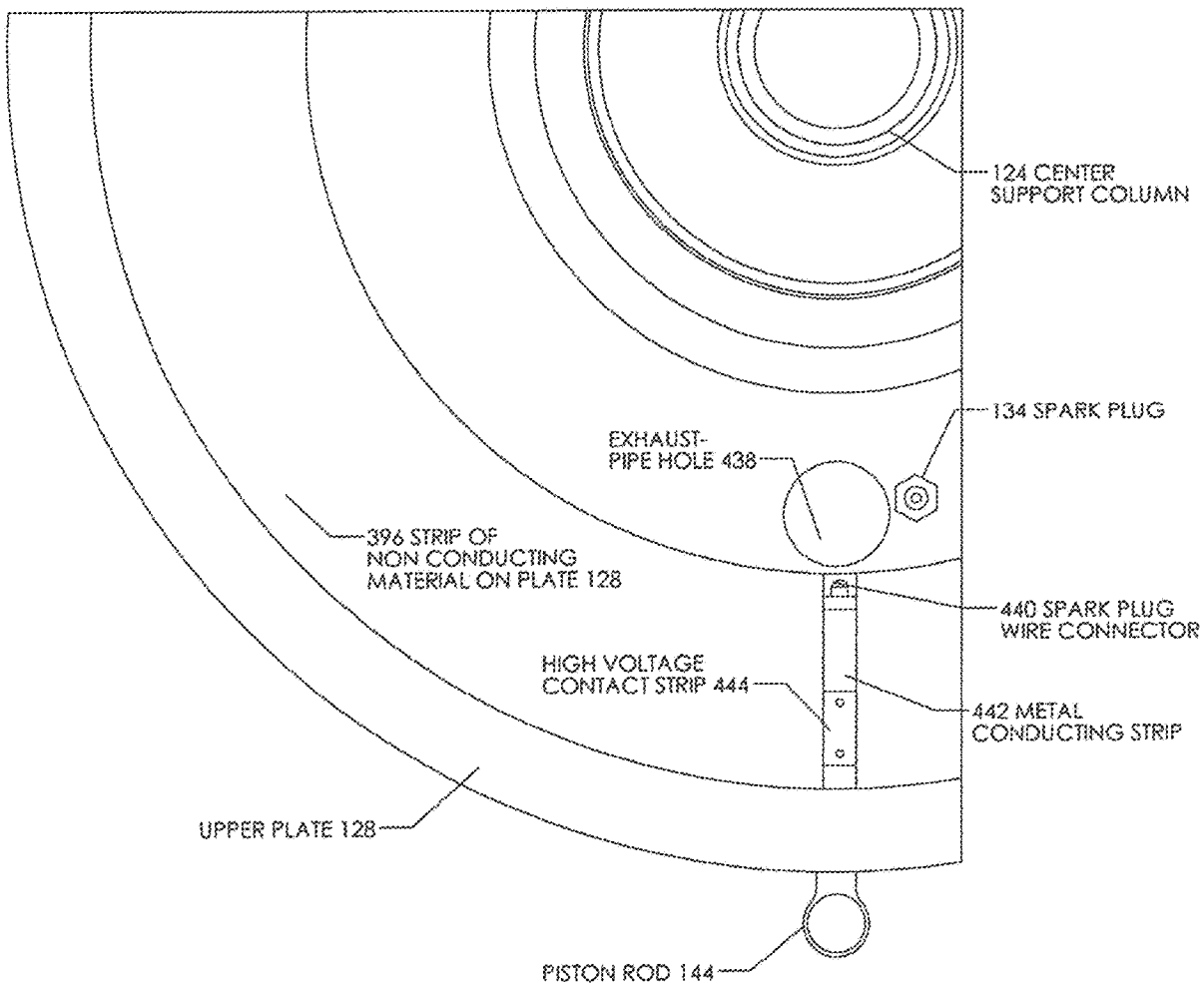
FIG. 20 is a top-down view illustrating portions of an example embodiment of an electrical system.
Figure 21:
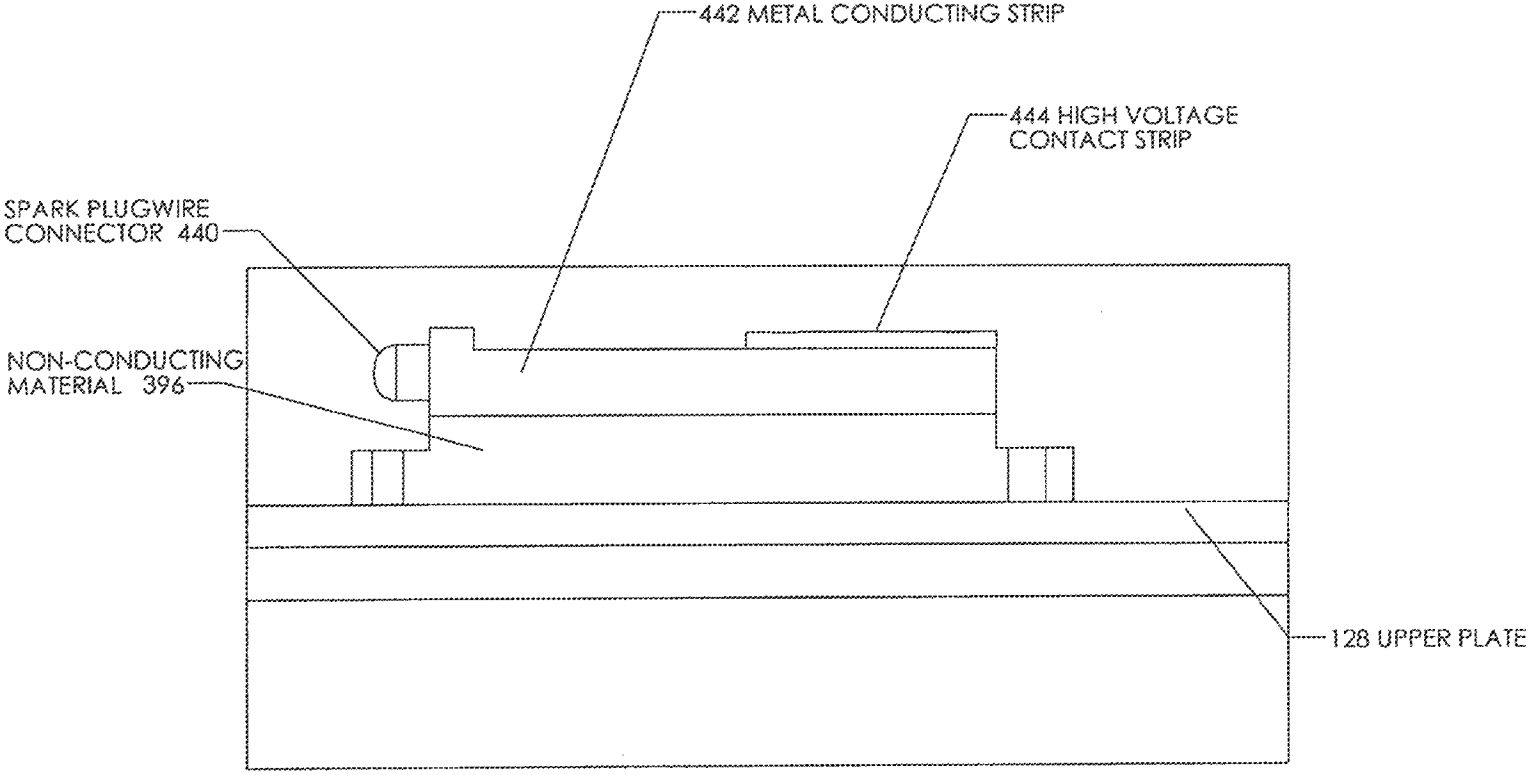
FIG. 21 is a schematic side view of portions of an embodiment of the electrical system.

FIG. 15 is an isometric view illustrating various portions of the components inside and above the inner disk 106 (upper rotating plate 128 is not shown). FIG. 15 illustrates the lower plate 130 having cooling holes, such as cooling hole 382. Cylinder 110 is secured to the lower plate 130. Spark plug 134 and fuel injector 222 provide spark and fuel to the combustion chamber of the cylinder 110. Spark plug 134 and fuel injector 222 are mounted in the cylinder head 212/combustion chamber area. The intake port 150 enters into the cylinder head 212/combustion chamber. Air intake port 150 supplies air to the combustion chamber of the cylinder 110. An electrical contact assembly 384 is also provided above cylinder 112 (upper plate 128 and non-conducting strip 396 are depicted in FIGS. 20 and 21). FIG. 15 also illustrates the camshaft 320 that extends from the cam spring enclosure 385. Upper camshaft bearing 328 provides a bearing, as well as an oil passage for camshaft 320. The top-positioning casting 324, which encases hearing 328, and camshaft 320 and oil passage 326 are not shown. Exhaust pipes 120 and additional exhaust parts are detailed in FIGS. 16 and 17.

Figure 16:
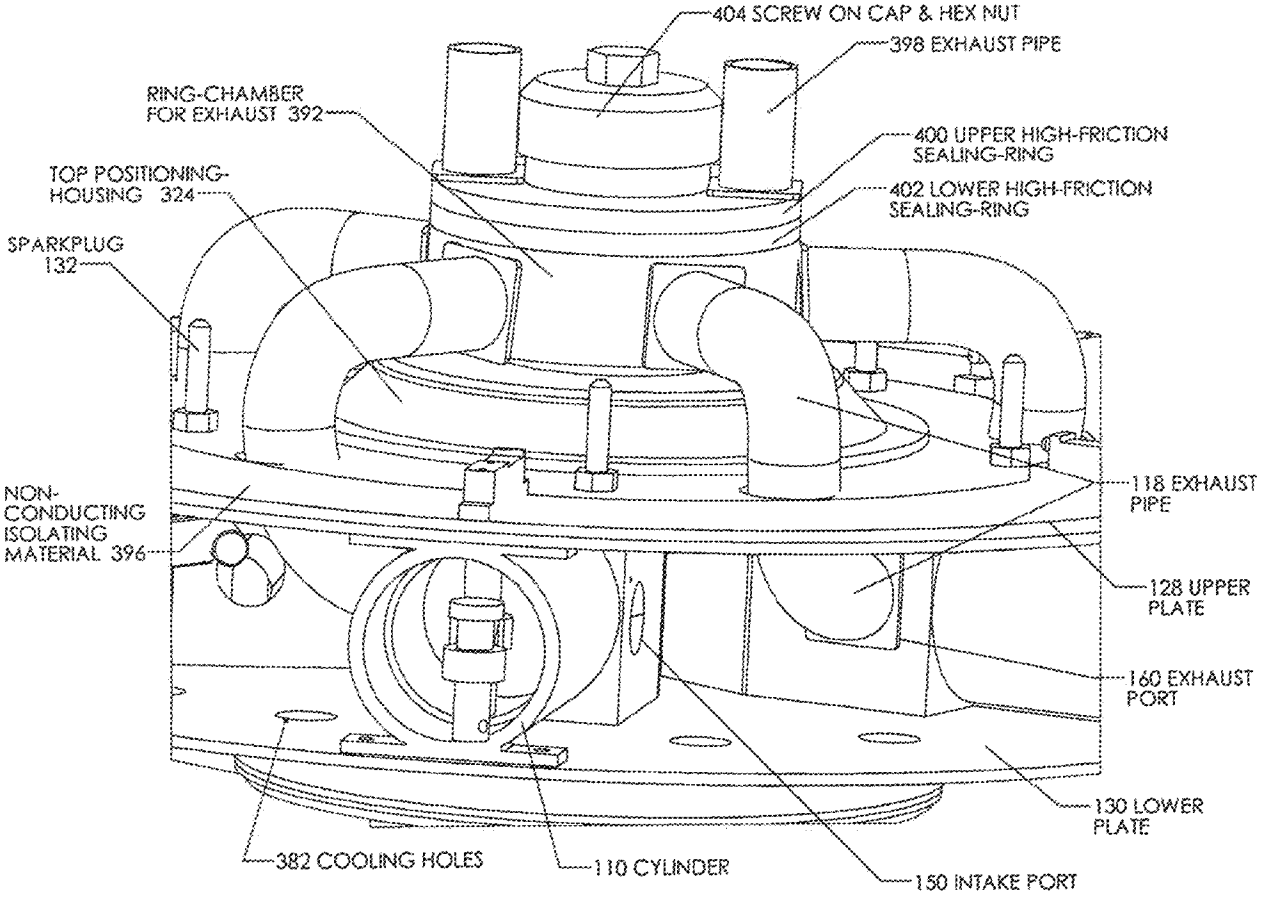
FIG. 16 is an isometric view illustrating an example embodiment of portions of the exhaust system.

FIG. 16 is an isometric view illustrating portions of the exhaust system. As illustrated in FIG. 16, cylinder 110 is located in the inner disk 106 (between rotating plates 128 and 130). Intake port 150 allows air to be drawn into the cylinder 110. Exhaust pipes, such as exhaust pipes 116, 118, take exhaust from exhaust ports 160 in the sides of the cylinders, through upper-rotating plate 128, and into the exhaust ring-chamber 392. Exhaust pipe 398 provides a conduit that takes the exhaust that flows into the exhaust ring chamber 392 to the outside of the engine. The ring chamber 392 is positioned over the top positioning casting 324. A non-conducting insulation material 396 is positioned on the top plate 128. The lower high-friction sealing ring 402 is placed directly on the top portion of the ring chamber 392. An upper high-friction sealing ring 400 is placed over the lower high friction sealing ring 402 that seals exhaust from leaking from the ring chamber 392. One or more exhaust pipes, such as exhaust pipe 398, are used for channeling the exhaust gas from ring chamber 392 to outside the engine.

Figure 17:
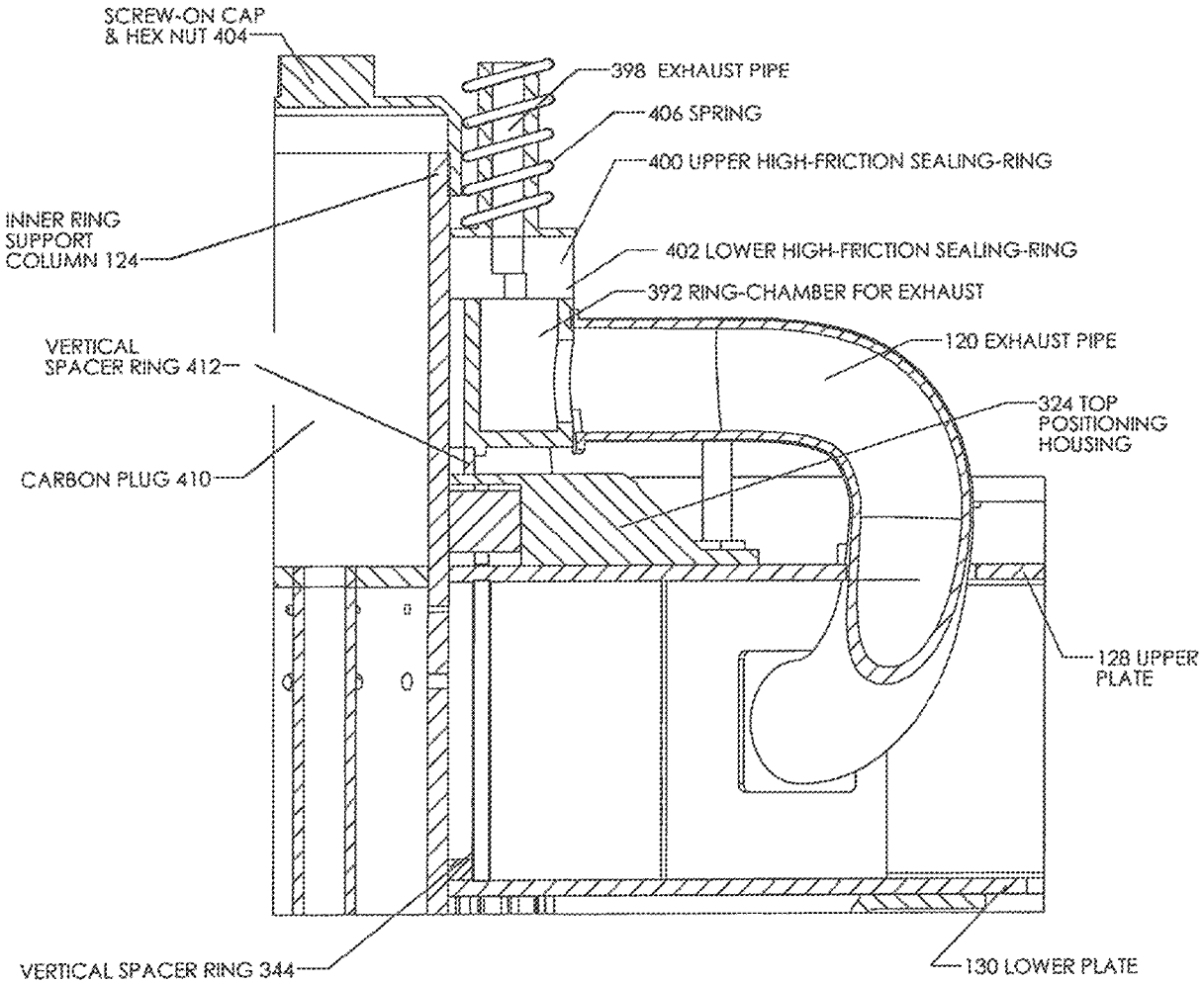
FIG. 17 is a cross-sectional view illustrating an example embodiment of details of the path of the exhaust and illustrates high-friction, high-heat sealing rings.

FIG. 17 is a cross-sectional view illustrating details of the path of the exhaust. As shown in FIG. 17, the upper and lower rotating plates 128 & 130 are spaced apart by the height of the cylinders. Also shown is vertical spacer ring 344, which the cylinders are positioned tightly against. Exhaust pipe 120 is shown in a cutaway view, which discloses the manner in which the exhaust pipe 120 enters the ring chamber 392. The lower friction-sealing ring 402 sits on the top of the ring chamber 392 and seals the ring chamber 392. The upper high friction-sealing ring 400 sits on top of the lower high-friction sealing ring 402. Spring 406 surrounds the exhaust pipe 398. Screw-on cap 404 covers the inner disk support column 124 and the carbon plug 410. FIG. 17 also illustrates the top positioning housing 324.

In operation, when the exhaust valve 254 opens to let exhaust flow into the exhaust passage 258 (see FIG. 8) that is connected to exhaust pipe 120, for example, exhaust passes into the exhaust pipe 120. The exhaust pipe 120 channels the exhaust gas to the ring chamber 392. Ring chamber 392 rotates with the inner disk 106 (FIG. 1). Ring chamber 392 sits atop spacer ring 412, which sits atop top positioning housing 324. The lower high-friction sealing ring 402 rotates with the ring chamber 392. The lower high-friction sealing ring 402 has a number of holes, so that exhaust can flow upwardly into two holes in the upper high friction sealing ring 400, as the lower high-friction sealing ring 402 rotates. The two holes in the upper high friction sealing ring 400 are aligned with the two exhaust pipes 398 (see FIG. 16). As the lower high-friction sealing ring 402 rotates, the holes in ring 402, periodically align with the two holes in the. upper high-friction sealing ring 400, which does not rotate. Consequently, exhaust flows upwardly into the exhaust pipes, such as exhaust pipe 398, and then outside the engine. The upper high-friction sealing ring 400 does not rotate, since it is attached to the exhaust pipe 398. Exhaust pipe 398 is pressed down against the non-rotating upper high-friction sealing ring 400 by spring 406. The spring extends from a horizontal extension at the bottom of exhaust pipe 398 to press against the upper engine housing 496, where the exhaust pipe 398 exits the upper engine housing 496 (see FIG. 23). Accordingly, the spring 406 holds the exhaust pipe 398 against the upper high-friction sealing ring 400. The connection of the exhaust pipe 398 to the upper high-friction sealing ring 400 and the interface of the upper high-friction sealing ring 400 and the lower high-friction sealing ring 402 are located inside the engine housing, so that if hot exhaust gases escape, these gases are still contained within the engine housing and can be pumped into the exhaust pipe(s) exiting the engine that take the exhaust gases to the catalytic converter and muffler, or some additional filtering/air-cleaning device (not shown). Furthermore, the exhaust pipes, such as exhaust pipe 120, are located at the top of the engine, so that the upper high-friction sealing ring 400 and the lower high-friction sealing ring 402 can be easily removed by removing the screw-on cap 404. Furthermore, carbon plug 410 insulates the lower part of the center-support-column 124 from the high exhaust heat. Carbon plug 410 also forms the top of the oil tube 310 and the idle-pressure fuel chamber inside support-column 124. Accordingly, FIG. 17 depicts a convenient way for handling the exhaust gases, reducing the high-heat friction that can otherwise be created, and for providing easy maintenance access to the high-friction part of the engine.

FIG. 18 is a cross-sectional view illustrating portions of the mechanisms of the inner disk and the flow of oil through the through the lower part of the inner disk. As depicted in FIG. 18, the inner disk support column 124 is illustrated, as well as cylinder 110 sitting on top of the lower rotating plate 130. Fuel ring 414 circles around the outer extension of the variable-pressure fuel pipe 416. The normal-pressure leaking-fuel container 420 forms the normal-pressure fuel-collection chamber 418. The normal-pressure fuel passage 421 passes through the vertical spacer ring 307. An expandable/flexible, high-friction washer 424 is provided adjacent to the vertical spacer-ring 307. Holes 426 are provided for the normal-pressure fuel leakage to flow from chamber 418 into the center-support-column 124. The bottom of the fuel chamber 428 is also illustrated in FIG. 18. Oil tube 310 is also illustrated in FIG. 18. The idle-pressure fuel chamber 430 is connected to the idle-pressure fuel pipe 432. Holes 434 are provided so that fuel flowing from idle-pressure fuel pipe 432 can flow from inside column 124 into groove 452 (shown in FIG. 19) in the expandable/flexible washer 424 and then through washer 424 and into variable-pressure fuel pipe 416. The top of the fuel chamber is referenced at 436.

Figure 19:
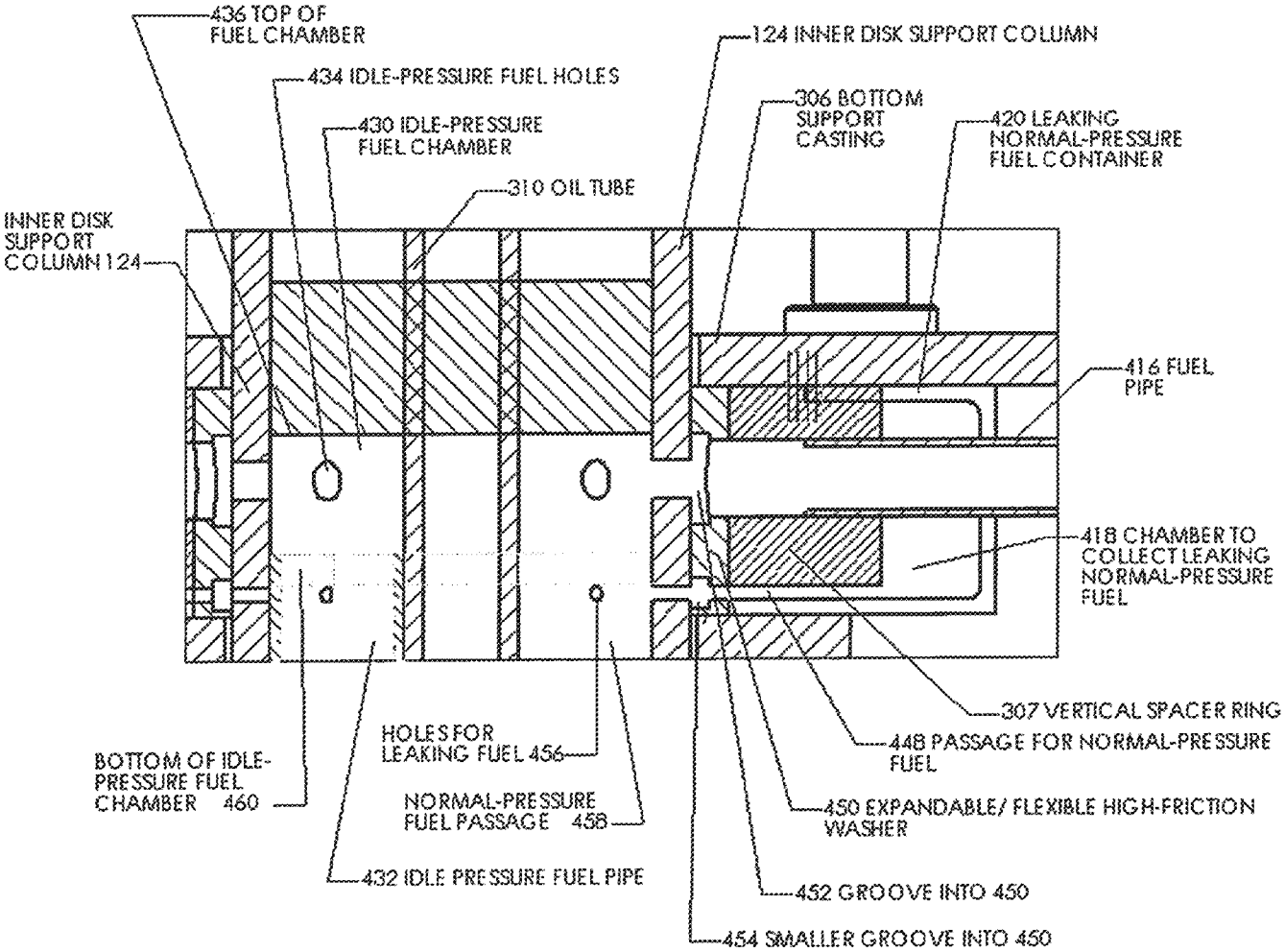
FIG. 19 is a side cutaway view of portions of an example embodiment of the fuel system.

FIG. 19 is a detailed cross-sectional view of portions of the fuel system. FIG. 19 shows the details of the manner in which fuel is transmitted to the fuel injectors, such as fuel injector 222 illustrated in FIG. 7, which are rotating on the inner disk 106. Fuel can be supplied as idle-pressure fuel, which is fuel going to the fuel injectors at a pressure level sufficient to keep the engine running at idle speed. The fuel is pumped upwardly through the inner disk support column 124 via idle-pressure fuel pipe 432 into the idle-pressure fuel chamber 430. The bottom 460 of the idle-pressure fuel chamber sits on top of the idle-pressure fuel pipe 432. The top 436 of the idle-pressure fuel chamber sits above the idle-pressure fuel holes 434. The bottom 460 of the idle-pressure fuel chamber is above the holes 456 for leaking fuel. The idle-pressure fuel holes 434 are approximately halfway up the idle-pressure fuel chamber. The idle-pressure fuel holes 434 are formed in the inner-disk support column 124. The idle-pressure fuel holes 434 allow fuel to flow from idle-pressure fuel chamber 430 into groove 452, which is located at the inner edge of the expandable & flexible high-friction washer 450. Washer 450 rotates with inner disk 106. Washer 450 is positioned between the inner-disk support column 124 and the vertical spacer ring 307. Washer 450 prevents idle-pressure fuel from leaking as much as possible at the point where the fuel flows from the non-rotating inner-disk support column 124 through idle-pressure fuel holes 434 to fuel pipe 416, which rotates with inner-disk 106, which also includes the rotating vertical spacer ring 307. Washer 450 also collects the fuel from the multiple holes 434 so that it then is available to the two idle-pressure fuel pipes 416.

As also illustrated in FIG. 19, the fuel pipe 416 is a variable-pressure fuel pipe, which becomes increasingly a high-pressure fuel supply as a result of the centrifugal forces on the fuel as it flows out toward the outer edge of inner disk 106. As illustrated in FIG. 18, the variable pressure fuel pipe 416 is bent upwardly, so that the variable-pressure fuel pipe 416 contacts the lower rotating plate 430. At this point the variable pressure fuel pipe 416 then contacts with the fuel ring 414, which is fastened under, and circles around, the inner disk 106. The fuel ring 414 of FIG. 18 has five points where T connections are provided, such that smaller fuel tubes extend vertically through openings in the inner disk 106. The fuel tube 416 provides fuel at the outer edge of the inner disk 106 to take maximum advantage of the centrifugal force that creates a high-pressure fuel in the fuel pipe 416. In addition, with respect to both FIGS. 18 and 19, cooling air is constantly pumped through the inner disk 106 to cool the various fuel tubes.

Referring again to FIG. 19, idle-pressure fuel may leak as it passes from the inner disk support column 124, which is not rotating, to the fuel pipe 416, around the expandable and. flexible high-friction washer 450. Chamber 418 collects the leaking normal-pressure fuel. Chamber 418 is formed by the normal-pressure leaking-fuel container 420. Fuel from chamber 418 flows through the normal-pressure fuel passage 448 back into the inner disk support column 124 to the normal-pressure fuel passage 458 via the groove 454 in the expandable and flexible washer 450. The normal-pressure fuel flows down inside support column 124 and then is fed back to the outside fuel pump (not shown) via pipe 512 (shown in FIG. 23). Since the passage 448 for the normal-pressure fuel ends just before passage 448 reaches the inner-disk support column 124, and passage 448 is surrounded by the expandable and flexible high-friction washer 450, fuel does not leak into the lower engine housing 498, illustrated in FIG. 23.

The structure and fuel flow illustrated in FIGS. 18 and 19 provides a variable-pressure fuel flow to injectors 222 as an alternative to the current state-of-the-art gasoline direct injection system. The variable-pressure fuel injector includes an ultra-lean burn mode, a stoichiometric mode, and a full-power mode, all of which inject different amounts of fuel, depending on whether the engine is in an idle state, a light-running, moderate-load condition, or a high-power rapid acceleration condition.

However, instead of just three distinct modes, the injection system of engine 100 is variable, meaning that the pressure of the fuel of the injection system varies continuously from a base of low rotation and modest centrifugal force, which is just enough to keep the engine idling (idle-pressure fuel) through a continuously increasing rate of revolution to the highest rotational speeds for the highest-power mode, in which centrifugal force is at its highest and fuel is delivered in its very highest-pressure fuel mode.

FIG. 20 is a top-down view illustrating portions of an embodiment of the electrical system for supplying high voltage/current to the spark plugs. The embodiment of FIG. 20 shows the upper plate 128 with a strip 396 of non-conducting material positioned on the upper plate 128. The strip 396 should he sufficiently thick to isolate the charges transmitted to the high-voltage contact strip 444 and the metal-conducting strip 442 from the rest of the engine. For example, an insulating strip having a thickness of approximately one-half inch may be suitable to provide this insulating layer. The strip 396 of the non-conducting material is located outwardly from the exhaust pipe hole 438 on the upper plate 128. A spark plug wire connector 440 is connected to the metal conducting strip 442 to transfer the charge to the spark plug 134 via a spark plug wire (not shown). The strip 396 may he attached to the upper plate 128 using any desired method, including the use of adhesives or other methods. The high voltage contact strip 444 and the metal conducting strip 442 may also be attached to the strip 396 using any desired method, including adhesives.

FIG. 21 is a side view illustrating portions of the electrical-contact assembly 384 shown in the embodiment of FIG. 20 (also shown in FIG. 15). As illustrated in FIG. 20, the non-conducting material strip 396 is attached to the upper plate 128. The metal conducting strip 442 is attached to the strip 396 using any desired attachment means, including, but not limited to, adhesive. The spark plug wire connector 440 forms part of the metal conducting strip 442. A high voltage contact strip 444 is secured to the top of the metal conducting strip 442. The high-voltage contact strip 444 provides a method for transferring high-voltage current from the high-voltage ignition coil (external from the engine), which is supplied by a contact device 492 (FIG. 23) sticking down from the upper engine housing 496 (shown in FIG. 23).

Figure 22:
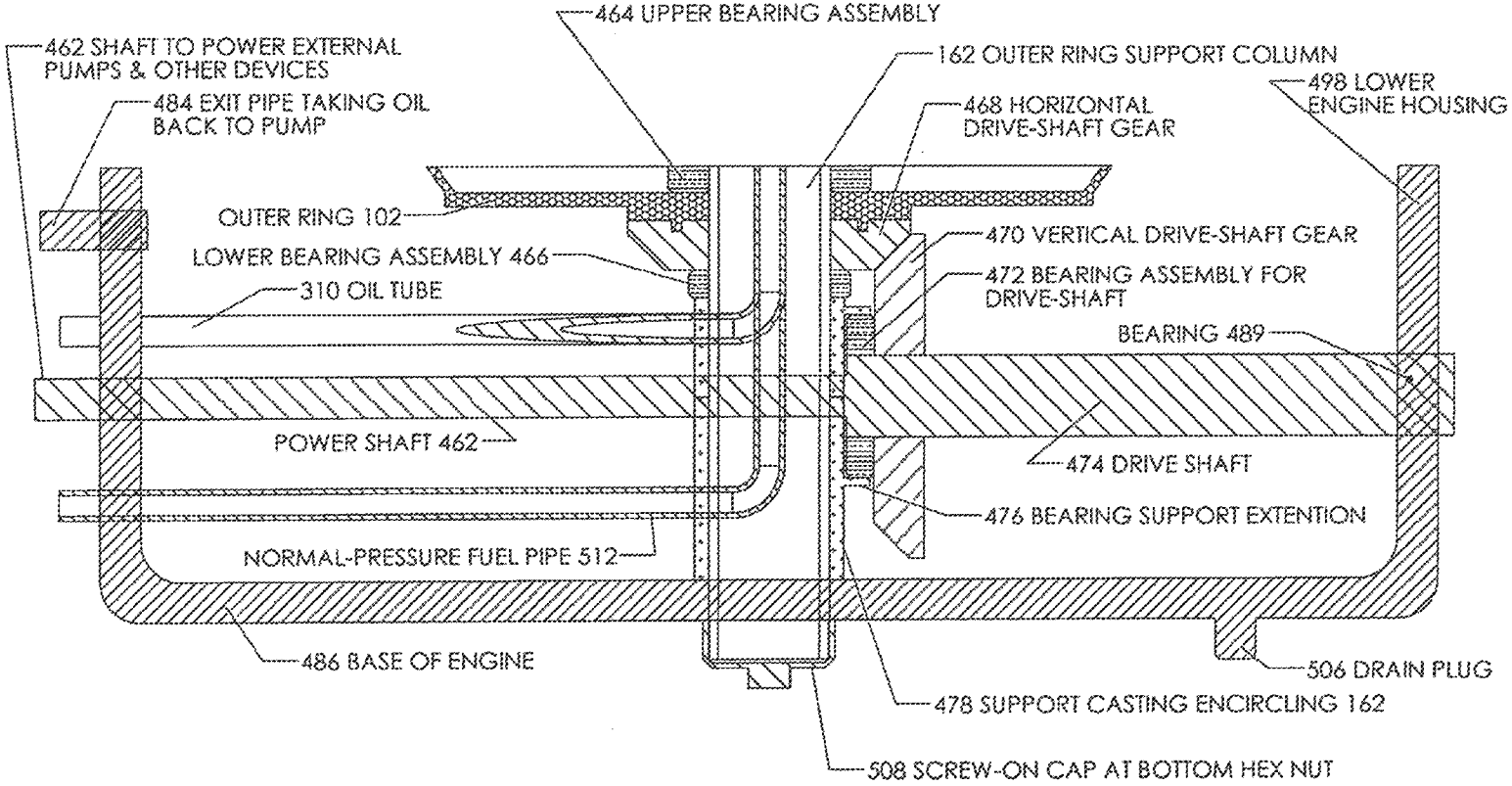
FIG. 22 is a side cutaway view of an embodiment of a lower portion of the engine housing.

FIG. 22 is a side cross-sectional view of the lower portion of the lower engine housing 498, support casting 478, bearing assemblies and the manner in which the driveshaft 474 is powered. The vertical support casting 478 encircles the lower portion of the outer ring center support column 162 and is positioned on the base 510 of the lower engine housing 498. The outer-ring support column 162 extends through the base 510 of the lower engine housing 498 and is held in place by screw-on cap 508. The lower bearing assembly 466 supports the outer ring 102. Lower bearing assembly 466 is supported by the support casting 478. The screw-on cap 508 is below the engine base 510 and pulls the outer ring support column 162, as well as everything connected to the support column 162, solidly down against the base 510. Support casting 478 also supports bearing assembly 472 for the driveshaft 474. Support casting 478 assists in positioning, rotational stability, and vertical support of the outer ring 102. The base 510 of the lower engine housing 498 is fastened to the chassis of an automobile or other device in which the engine is mounted. The attachment can be by bolts or other fastening methods. Oil tube 310 extends inside lower engine housing 498 and then into inner-disk support column 124. In this manner, oil can be delivered to other portions of the engine via support column 124. Exit pipe 484 allows oil to exit the bottom portion of the lower engine housing 498 for return to the oil pump (see FIG. 2). In addition, a drain plug 506 allows the oil to be drained from the lower engine housing 498.

As also illustrated in FIG. 22, horizontal driveshaft gear 468 is coupled to the outer ring 102. Horizontal driveshaft gear 468 meshes with vertical driveshaft gear 470 to drive the driveshaft 474. A bearing 489 is mounted in the lower engine housing 498 to support the driveshaft 474. Support casting 478 has a bearing bracket cast 476, which forms a portion of the support casting 478, to support and position the bearing assembly 472 for the driveshaft 474. Bearing 489 also contains a flexible sealing material that keeps oil from leaking out of the lower engine housing 498. Power shaft 462 is connected to driveshaft 474 and extends out of the lower engine housing 498 to power external devices. Shaft 462 is supported by bearings and seals, which are not shown, FIG. 22 also illustrates the normal pressure fuel pipe 512, which extends into the lower center-support-column 162, and then rises up into inner disk center support column 124. Oil tube 310 does not join with the normal pressure fuel pipe 512, but rather is behind the normal pressure fuel pipe 512, as shown in the "open" 3D view shown in FIG. 23.

FIG. 23 is an isometric view of the embodiment of the offset rotational non-reciprocating-piston internal combustion engine described above. As illustrated in FIG. 23, the offset internal combustion engine 100 has an engine base 510 that is shown in a cross-sectional cutaway view. The engine base 510 surrounds the internal parts of engine 100, The outer ring support column 162 is coupled to the engine base 510 by way of screw-on cap 508. Oil drain plug 506 allows oil to be drained from engine 100. Pipe 512 allows normal pressure fuel to exit engine 100. Pipe 432 allows idle pressure fuel to enter the engine 100. Oil tube 310 provides a supply of lubricating oil. Power-shaft 462 is coupled to the driveshaft 474 and provides a mechanical element for driving external devices. Vertical driveshaft gear 470 drives driveshaft 474. Horizontal driveshaft gear 468 drives vertical driveshaft gear 470, Horizontal driveshaft gear 468 is coupled to the outer ring gear 172. Outer ring gear 172 is driven by transfer gear 166. Transfer gear 166 and transfer gear 164 are held in place by bracket 168. Via transfer shaft 167 (not shown), transfer gear 166 is driven by transfer gear 164, which is in turn driven by the internal disk gear 170. Internal disk gear 170 is connected to the inner rotating disk 106. In this fashion, the inner-disk 106 and the outer ring 102 rotate together in the manner described in FIGS. 4A-4E and 5A-5E. To add rotational stability, outer ring 102 is positioned between lower support bearing assembly 466 and upper bearing assembly 464.

As also shown in FIG. 23, cooling air enters through openings 500 in the lower engine housing 498. The upper engine housing 496 provides a cover for the inner rotating disk 106 and outer ring 102. The inner disk 106 includes cylinders, such as cylinders 108, 110, & 112, as illustrated in FIG. 1. Exit pipe 494 provides an exit for the cooling air for engine 100. Exhaust pipes 398 provide an exit for the exhaust from the engine. Connector 492 provides a connection for passing high voltage current from the external high-voltage coil to spark plugs 220.

Hence, the offset rotational non-reciprocating-piston internal combustion engine 100 embodies many of the advantages of conventional reciprocating-piston internal combustion engines and rotational engines, such as the Wankel engine. Most importantly, this offset rotational internal combustion engine 100 has neither reciprocating pistons nor reciprocating cylinders. Instead, the pistons rotate in a circle with no vibration and, similarly, the cylinders rotate in a circle with no vibration, but the rotational axis of the cylinders is offset from the rotational axis of the piston, as illustrated in FIGS. 4A-4E and FIGS. 5A-5E. The result is that neither the cylinders nor the pistons are reciprocating, except with respect to one another. Consequently, the engine's vibration is minimized. The cylinders and other apparatus that are mounted on the internal disk 106 are symmetrical and do not generate vibration. The amount of the offset determines the amount of compression and expansion between the piston and the cylinder. For example, a one-inch offset generates a two-inch relative movement between the pistons and the cylinders.

Furthermore, most of the mass of engine 100 is located near the center of the engine on the internal disk 106, rather than being mounted on the outer ring, which results in the engine 100 being less susceptible to imbalance and vibration. Additionally, positioning the valves vertically, or mounting them on top of the cylinders may further reduce the rotating mass. This reduces the radiuses of the cylinder wheel and outer rotating ring. The need for counterweights, a strong crankshaft, flywheel and heavy-duty crankcase construction is minimized, since vibration is miniscule. In addition, the rotating outer ring 102 functions as a flywheel.

Also, the example offset rotational non-reciprocating-piston internal combustion engine 100, illustrated herein, has many fewer parts than any standard internal combustion engine and, therefore, failure and maintenance of parts are reduced. The variable-pressure fuel injector system also offers a more effective alternative to currently available gasoline direct injection (GDI) systems. Specifically, conventional, existing, direct injection of gasoline operates in three distinct modes, i.e., ultra-lean burn, stoichiometric, and full-power method, which is based upon the use of the engine control unit/engine management system (EMS). The variable-pressure fuel injector system disclosed herein allows fuel pressure to vary continuously from a low rotation and modest centrifugal force resulting from a fuel pressure that is just high enough to keep the engine idling, through a continuously increasing rate of revolution and fuel pressure to a maximum revolution, highest-power mode, based on the high-speed rotation of the internal disk 106 and outer ring 102. The embodiments of the offset rotational non-reciprocating internal combustion engine 100 use the increasing rotational speed of the outer ring 102 to replace the GDI and EMS systems so as to create an ever-increasing fuel pressure, based upon the centrifugal forces on fuel flow. As such, depending upon the speed of rotation, the fuel pressure increases from an idle pressure to a higher pressure, and then to a maximum pressure, as the rotational speed increases to the maximum. The rotational speed of the engine alters the fuel volume to the cylinders by increasing or decreasing the pressure of the fuel flowing into the engine.

Because of its miniscule vibration, rotational engine 100 is capable of high rotational speeds; high enough in fact that turbo supercharging is feasible and desirable to increase the speed of air-flow and air-intake into the cylinders.

Using a sturdy structure, the offset rotational internal combustion engine 100 may be employed as a diesel engine, The basic principles of operation, of course, would apply to the diesel engine embodiment.

The exhaust-evacuation design reduces rotary friction because the exhaust-evacuation system is designed so that the high-heat/high-friction "ring-style" exhaust-transfer chambers 392, 402, 400 are positioned as close around the inner disk support column 124 as possible. This minimizes friction as the exhaust is transferred from the rotating ring 402 to the non-rotating ring 400. Previous rotating engines, such as the Wankel engine, are not widely used because of the fact that the friction surface was large, high-pressured, and located a substantial distance from the rotating axis. The high friction seals in the Wankel engine tended to fail because of the high friction that was required to maintain the seal over a large surface. The constant presence of high-pressure, high-heat friction impeded rotation and created a need for high maintenance, loss of power, and inefficiency in the Wankel engine. By placing the seal as close as possible to the center of the rotating axis, as illustrated in the embodiments disclosed herein, the surface area of the seal was greatly reduced, as well as the lever arm, and the high forces that were required over a large surface are in order to create a seal in the Wankel-type engine. Further, the overall design of the engine 100 allows the exhaust ring seals to be easily replaced by removing the screw-on cap 404. Further, the exhaust pipes 398 are well separated from the air intake passages. Also, the flow of the intake air is efficient and is suitably separated from the oil and exhaust flows. Lubricating oil is pumped up via oil tube 310, which is inside the inner disk support column 124 and then centrifugal force and gravity assure further flow toward and into various parts of the engine that are located outwardly from the inner disk support column 124.

The offset rotational internal combustion engine 100 is air-cooled. Cooling air is pumped through the lower section of the engine using an external blower. Fan blades, which are not shown, on the bottom of the outer ring 102, assist in causing the cooling air to flow up into the rotating and heat-generating parts of the engine. Centrifugal forces move air throughout the internal portions of the engine and then force the cooling air to move upwardly into the areas of the exhaust system, and finally out of the engine via the exit pipe 398.

The overall design of the offset rotational non-reciprocating-piston internal combustion engine 100 is a design in which items are symmetrically stacked in a vertical direction for easy access by unscrewing the screw-on cap 404. By removing the screw-on cap at the top of the inner disk support column 124, all of the engine parts can be accessed, maintained, replaced or tightened using hand tools. Once the upper parts of the engine are removed, unscrewing lower screw-on cap 508 allows the lower portion of the engine parts to be removed. An opening in the side of the lower engine housing 498 (not shown) is necessary so that pipes 310, 432, 484 may be disconnected as well as shafts 462, 474. Special tools and special equipment are not required to access and maintain or repair the offset rotational internal combustion engine 100. The offset rotational non-reciprocating internal combustion engine 100 is especially well suited for hybrid automobiles, as well as motorboats, trucks, piston-based compressors, piston-engine powered electric generators, etc. because of the manner in which combustion forces the rotation of the outer ring 102. Because of its rotational design, this engine 100 is especially well suited for propeller-driven light airplanes.

Although the engine design of the offset rotational non-reciprocating-piston internal combustion engine 100 has been described with respect to fuel injectors, the engine may utilize an air/gasoline mixture that can be routed through the internal disk support column 124 directly to the intake valves of the cylinders.

The offset rotational non-reciprocating-piston internal combustion engine 100 can also be modified to operate as a compressor. The driveshaft 474 can be driven by an external source, which causes the outer ring 102 and inner disk 106 to rotate, so that air or other gases can be compressed by the cylinders to create compressed gases.

While not shown in the figures of the examples described above, some reinforcing of the lower engine housing 498 should also be provided for an operating engine to add stability to the rotation of the outer ring 102 when a combustion explosion occurs. For example, bearings can be added to stabilize the rotation of the outer ring 102 and an additional stiffening ring could be fastened to or cast into the outside of the lower engine housing 498 in the area where the piston-rod connectors 147 are located.

The foregoing description of the invention has been presented for purposes of illustration and description. It is not intended to be exhaustive nor to limit the invention to the precise form disclosed; other modifications and variations may be possible in light of the above discourse. This embodiment was chosen and described in order to best explain the principles of the invention and its practical application so as to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. An offset rotational internal combustion engine comprising:

an outer ring that rotates substantially symmetrically around an outer-ring rotational axis;

pistons that are attached to said outer ring;

an inner disk located inside of said outer ring that rotates around an inner disk rotational axis, said inner disk rotational axis being offset from said outer-ring rotational axis;

cylinders mounted on said inner disk that engage said pistons;

gears connected to said inner disk and said outer ring that cause said inner disk and said outer ring to rotate together so that said cylinders on said inner disk are substantially aligned with said pistons attached to said outer ring when said outer ring rotates around said outer ring rotational axis and said inner disk rotates around said inner ring rotational axis;

a fuel pipe extending from an inner disk support column toward an outer edge of said inner disk to a fuel pipe that encircles said outer portion of said inner disk that uses centrifugal force from increased rotational speed to increase fuel pressure from said fuel pipe to injectors which supplies additional fuel and power to said engine;

a primary oil tube located in an inner disk support column;

additional oil tubes located in said inner disk that transfer oil from said primary oil tube to components of said engine located on said inner disk by using both an external oil pump and centrifugal forces on said oil created by rotation of said inner disk;

caps that are bolted to top and bottom portions of an end of an upper center support column and an end of a lower center support column that cover said engine and allow said engine to be quickly and easily accessed so that internal portions of said engine can be disassembled, maintained, and re-assembled with standard hand tools.

2. The engine of claim 1 further comprising:

spark plugs, exhaust pipes, camshafts, and cam gears mounted on said inner disk so as to minimize rotational vibration of said engine.

3. The engine of claim 2 wherein camshafts, valves, and other components of said engine are positioned in a direction that is parallel to said inner disk rotational axis, which minimizes rotational momentum, inertia, and vibration of said inner disk, and provides access to engine parts for maintenance and repair.

4. The engine of claim I wherein said engine operates as a gasoline fueled engine.

5. The engine of claim I wherein said engine operates as a diesel engine.

6. The engine of claim l wherein said engine operates as a gaseous fueled engine.

7. The engine of claim 6 wherein said engine comprises an engine that is fueled by natural gas.

8. A method of making an offset rotational internal combustion engine comprising:

an outer ring that rotates substantially symmetrically around an outer ring rotational axis;

attaching pistons to said outer ring;

providing an inner disk positioned inside of said outer ring that rotates around an inner disk rotational axis that is offset from said outer ring rotational axis;

mounting cylinders on said inner disk that engage said pistons;

providing gears that cause said outer ring and said inner disk to rotate together so that said cylinders on said inner disk are substantially aligned with said pistons attached to said outer ring when said outer ring rotates around said outer ring rotational axis and said inner disk rotates around said inner disk rotational axis;

mounting a fuel ring near an outer edge of said inner disk to create higher fuel pressures caused by centrifugal force on fuel as a result of centrifugal forces on said fuel that are caused by increased rotation speed of said inner disk;

distributing oil to said engine through an oil tube inside a stationary inner disk support column that is connected to oil tubes disposed in a direction toward an outer edge of said inner disk, so that oil flows through said engine as a result of centrifugal force on said oil from rotation of said inner disk;

assembling said engine using caps that are secured at a top end portion of said inner ring support column and a bottom end portion of an outer-ring support column, such that said engine can be assembled and disassembled with standard hand tools.

9. The method of claim 8 further comprising:

mounting spark plugs, exhaust pipes, camshafts, and cam gears near a center portion of said inner disk so as to minimize rotational vibration of said engine.

10. The method of claim 8 wherein portions of said engine are vertically positioned on said inner disk so as to minimize rotational vibration of said engine and provide easy access to engine parts for maintenance and repair.

11. The method of claim 8 wherein said internal combustion engine is a gasoline fueled engine.

12. The method of claim 8 wherein said internal combustion engine is a gaseous fueled engine.

* * * * *